US005628620A

United States Patent [19]

Arlton

[11] Patent Number: 5,628,620

[45] Date of Patent: May 13, 1997

[54] MAIN ROTOR SYSTEM FOR HELICOPTERS

[76] Inventor: Paul E. Arlton, 1132 Anthrop Dr., West Lafayette, Ind. 47906

[21] Appl. No.: 233,159

[22] Filed: Apr. 25, 1994

Related U.S. Application Data

[63] Continuation-in-part of Ser. No. 770,013, Sep. 30, 1991, Pat. No. 5,305,968.

[51] Int. Cl.[6] ..... B64C 27/00

[52] U.S. Cl. ..... 416/114; 416/103; 416/104; 416/106; 446/36; 446/37; 446/38; 446/39; 446/40; 446/41; 446/42; 446/43; 446/44; 446/45

[58] Field of Search ..... 416/142, 103, 416/104, 106, 107, 141, 153; 446/36–45

[56] References Cited

U.S. PATENT DOCUMENTS

| | | | |
|---|---|---|---|
| 1,870,928 | 8/1932 | Smith | 416/104 |
| 2,021,481 | 11/1935 | Dornier . | |
| 2,086,802 | 7/1937 | Hays | 416/103 |
| 2,311,247 | 2/1943 | Pitcairn | 416/106 |
| 2,384,516 | 9/1945 | Young . | |
| 2,614,640 | 10/1952 | Buivid | 416/107 |
| 2,631,679 | 3/1953 | Hiller, Jr. et al. . | |
| 2,689,099 | 9/1954 | Lightfoot . | |
| 3,004,736 | 10/1961 | Culver et al. . | |
| 3,027,948 | 4/1962 | Goland et al. . | |
| 3,108,641 | 10/1963 | Taylor . | |
| 3,211,235 | 10/1965 | Bretl . | |
| 3,228,478 | 1/1966 | Edenborough . | |
| 3,232,348 | 2/1966 | Jarosch . | |
| 3,528,633 | 9/1970 | Knemeyer . | |
| 3,532,302 | 10/1970 | Dean . | |
| 4,118,143 | 10/1978 | Kavan . | |
| 4,195,966 | 4/1980 | Cornelius . | |
| 4,272,041 | 6/1981 | Mabuchi et al. . | |
| 4,419,051 | 12/1983 | DeRosa | 416/141 |
| 4,738,592 | 4/1988 | Cavanaugh . | |
| 4,759,514 | 7/1988 | Burkam . | |
| 5,252,100 | 10/1993 | Osawa et al. | 446/44 |
| 5,322,415 | 6/1994 | White et al. . | |

FOREIGN PATENT DOCUMENTS

| | | | |
|---|---|---|---|
| 0466503 | 7/1950 | Canada | 416/141 |
| 0080292 | 6/1983 | European Pat. Off. | 416/142 |
| 0126370 | 7/1959 | U.S.S.R. | 416/103 |
| 0452407 | 8/1936 | United Kingdom | 416/141 |
| 0623474 | 5/1949 | United Kingdom | 446/39 |

OTHER PUBLICATIONS

*R/C Feel Out The Helicopter A to Z*, two page sales brochure for model helicopters produced by Kyosho Co. of Kanagawa Pretecture. Date unknown. Illustrations in brochure show the structure of the helicopter including the main rotor, tail rotor, frame, and landing gear.

Information concerning the Graupner Heim helicopter contained in *Neuheiten* '91, pp. 22–23. Illustrations show the structure of the helicopter including the main rotor, frame, and landing gear.

Building Instructions for the Champion model helicopter produced by Hubschrauber Schluter. Two pages. Date unknown.

(List continued on next page.)

*Primary Examiner*—Edward K. Look
*Assistant Examiner*—Mark Sgantzos
*Attorney, Agent, or Firm*—Barnes & Thornburg

[57] ABSTRACT

A main rotor is provided for use in a rotary winged model aircraft. The main rotor includes a rotor hub assembly rotatable about a vertical axis and at least two main rotor blades. Each of the main rotor blades extends in a radial direction from the rotor hub assembly. The main rotor blades each include a tip end positioned to lie in spaced-apart relation to the rotor hub assembly and a root end coupled to the rotor hub assembly for pivotable folding movement from an initial horizontal position perpendicular to the vertical axis about a horizontal axis through a desired folding angle of about 90°. Forces transmitted to the rotor hub by the rotor blade during a crash-landing of a rotary winged model aircraft including the main rotor are minimized due to movement of the rotor blades through the desired folding angle.

36 Claims, 24 Drawing Sheets

OTHER PUBLICATIONS

Building Plans for X–Cell thirty and forty series model helicopter produced by Miniature Aircraft USA, 1989, two pages.

Sales brochure for the Petit Helicopter, Sports Flight Helicopter, and helicopter accessories contained in the sales catalog for Hirobo Limited.

Sales brochure for the Whisper Electric helicopter distributed by Hobby Dynamics Distributors. One page. Date unknown.

*Rotary Modeler*, May/Jun., 1992. One page.

Rock, Gene, SSP–5, *American Aircraft Modeler*, Mar. 1973, pp. 41–45 and 76–79.

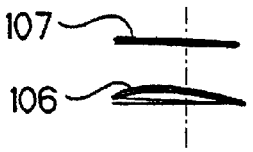
FIG. 21g
FIG. 21f
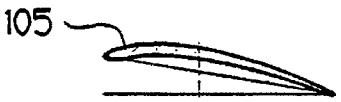
FIG. 21e
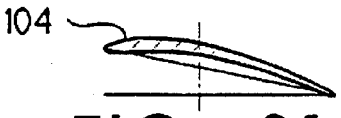
FIG. 21d
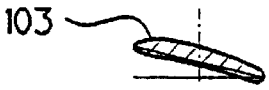
FIG. 21c
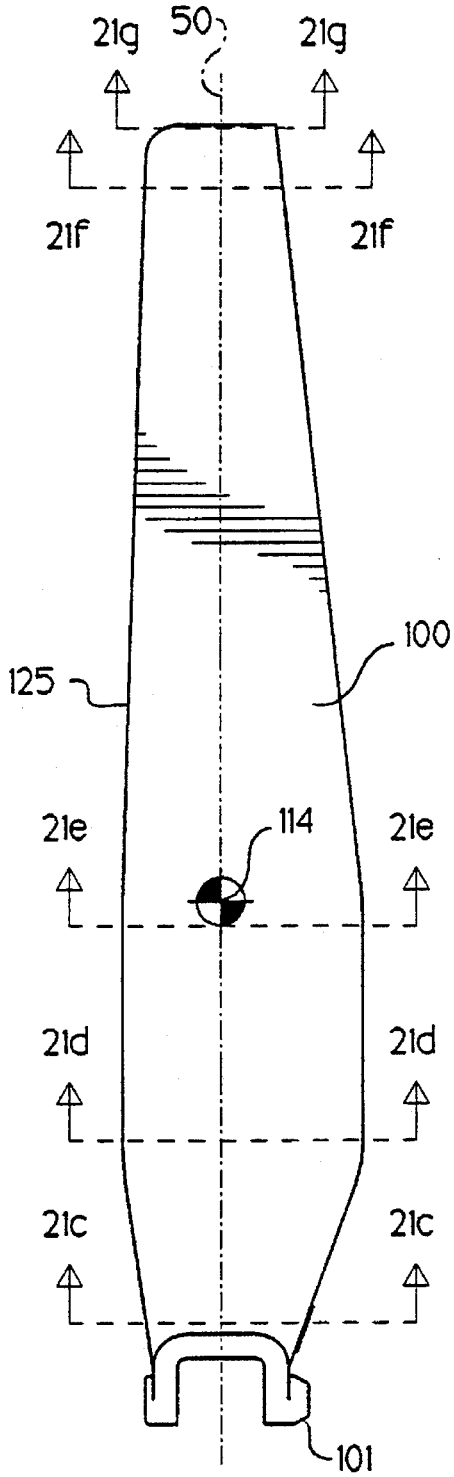
FIG. 21a
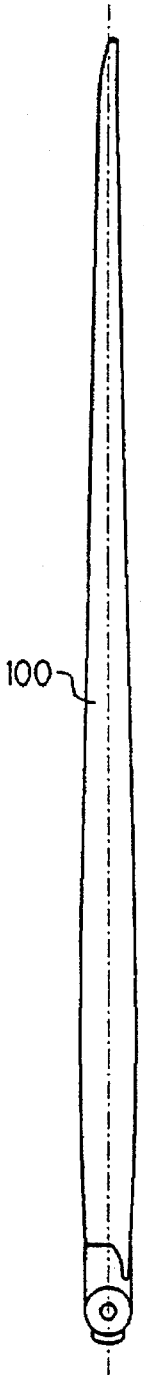
FIG. 21b

MAIN ROTOR SYSTEM FOR HELICOPTERS

This application is a continuation-in-part application of U.S. application Ser. No. 07/770,013, filed Sep. 30, 1991, now U.S. Pat. No. 5,305,968.

BACKGROUND AND SUMMARY OF THE INVENTION

The present invention relates to the field of thrust-producing rotors for both model and full-size helicopters. More particularly, the present invention relates to high lift rotors for all types of helicopters and to simple and inexpensive rotors for use in model helicopter applications.

Helicopters are flying machines with the ability to hover and fly forwards, backwards, and sideways. This agility stems from the multiple capabilities of the main rotor system. Since the invention of helicopters in the 1930's considerable effort has been expended advancing helicopter technology, with a substantial percentage of that effort concentrated on the main rotor system.

While the technology of full-size helicopters progressed, model helicopters remained impractical for decades for lack of suitable engines, radio control equipment, and construction materials. As the state-of-the-art in full-size helicopters advanced in the 1950's and 1960's, many novel model helicopter designs were developed, but none proved practical. Model helicopter designers often copied the designs of full-size helicopters without understanding the basic differences between full-size and model aircraft. As a result, scaled-down model helicopters were typically unstable and underpowered.

While mechanically similar, the aerodynamics, operational speeds, and weights of model helicopters are vastly different from those of their full-size counterparts. Model helicopter rotors operate within a low speed range where aerodynamic drag due to the thickness of the rotor blade airfoil becomes very important. Early attempts to utilize the thick airfoils used on full-size helicopters failed in part because engines then available could not overcome the high drag of the rotor blades.

In the 1970's hobbyists developed the first practical model helicopters. Lighter radio control equipment, more powerful engines, and systematic engineering all contributed to early successes. Much of model helicopter design, however, is rooted in tradition. Even though helicopter technology has advanced considerably since that time, the designs and design philosophies of that era are still in widespread use. With an better understanding of small-scale aerodynamics and kinematics, it is possible to devise a model helicopter rotor with capabilities beyond those currently available. Certain aspects of the rotor can benefit full-scale aircraft.

Because the main rotor system of a helicopter is capable of performing so many flight functions, it is usually very mechanically complex. Model helicopters currently available contain myriad pushrods, mixing arms, ball joints, and expensive ball bearings. Swashplate assemblies for controlling the main rotor often utilize specialty ball bearing units which drive the cost up further.

Considering the cost, complexity and lifting capabilities of modern rotor systems, what is needed is a high lift rotor system that is relatively simple, inexpensive, and easy to manufacture.

One object of the present invention is to provide a high-lift rotor system for full-size and model helicopters.

Another object of the present invention is to provide a simple inexpensive rotor system for use on model helicopters.

Generally speaking there is provided herein a main rotor system for a helicopter. Such device is generally mounted to a helicopter and provides a controllable motive force for lifting the helicopter into the air and propelling the helicopter in any direction.

More specifically, the rotor system includes rotor blades and subrotor blades for producing aerodynamic lift. These subrotor blades also act to augment control and stability of the rotor. The rotor system also includes a swashplate assembly and linkage means for transmitting pilot control commands to the rotating rotor blades.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIGS. 21*a–g* are views of a rotor blade in accordance with the present invention with details of airfoiled cross sections shown for several span-wise stations of the rotor blade shown in FIG. 21*a* to illustrate the twist and camber of the rotor blade.

DETAILED DESCRIPTION OF THE DRAWINGS

Figure 1:
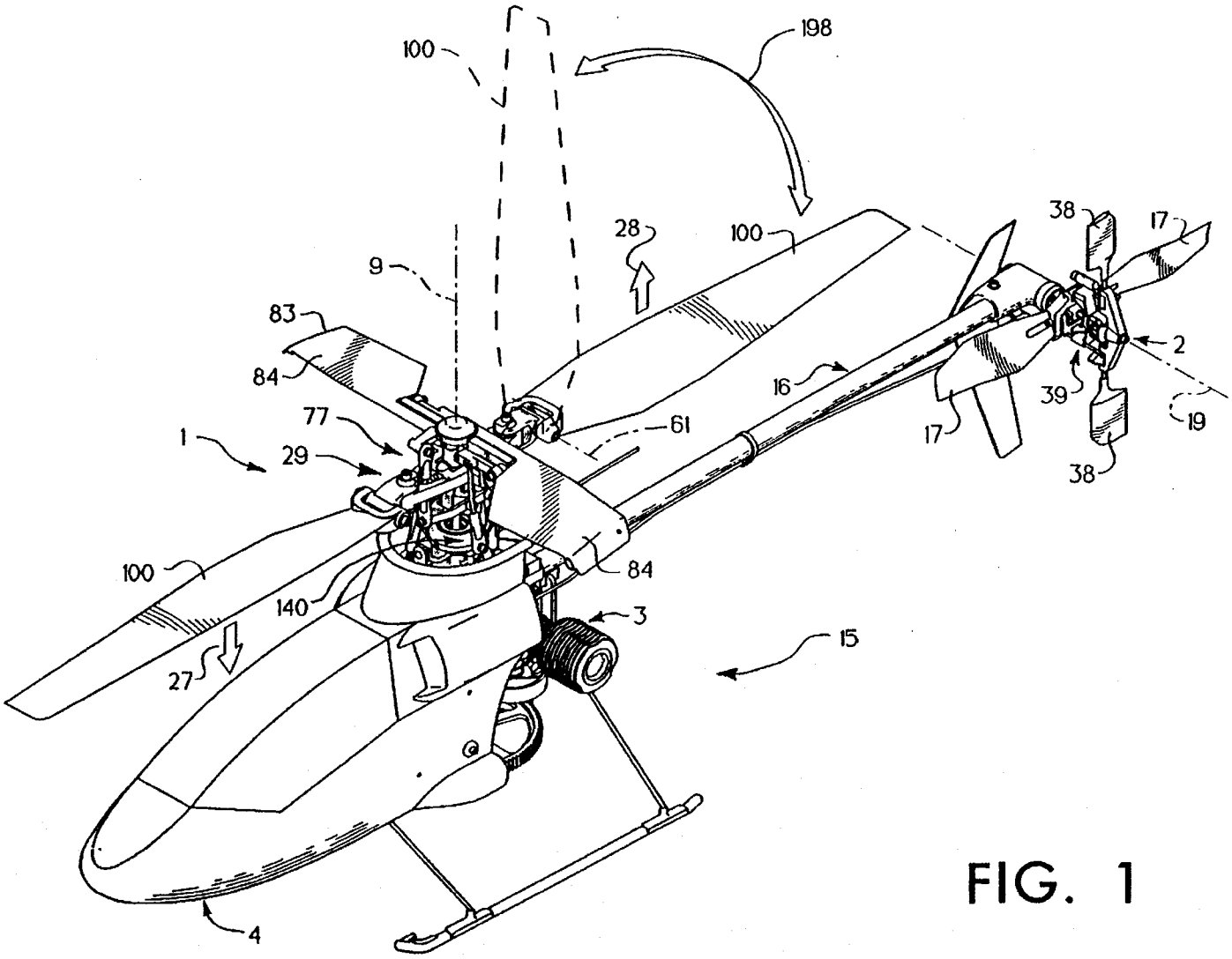
FIG. 1 is a perspective view of a model helicopter incorporating a main rotor system in accordance with a preferred embodiment of the present invention.

Referring to FIG. 1, a helicopter 15 in accordance with the present invention includes a large main rotor 1 which lifts the helicopter 15 into the air and a smaller tail rotor 2 which is used to counteract the torque produced by main rotor 1 and to steer the helicopter 15. Main rotor 1 rotates about vertical axis 9 and includes a pair of rotor blades 100 and a pair of shorter subrotor blades 84. Both main rotor 1 and tail rotor 2 are driven by an engine 3 usually located within the helicopter fuselage (body) near the vertical main rotor shaft 9. A streamlined fuselage shell 4 illustratively covers the front of the helicopter 15 without extending back along a tail boom 16 to the tail rotor 2.

From a distance, helicopter main rotors look superficially like large propellers sitting atop the helicopter fuselage. Like propellers, helicopter main rotors are designed to produce a thrust or lift force. Helicopter main rotors, however, operate in a manner completely different from propellers. Unlike propellers, they are designed to move through the air sideways; the lift force which keeps the helicopter aloft can also be directed to push the helicopter in any direction.

Tail rotor 2 is supported for rotation about a transverse tail rotor axis 19 as shown in FIG. 1. Tail rotor 2 functions to control the yaw motion of the helicopter on which it is mounted. Yaw motion is an angular motion of helicopter 15 about a vertical axis such as main rotor axis 9.

Tail rotor 2 includes a rotor shaft, a pair of tail rotor blades 17, and a pair of secondary blades 38 coupled to a mechanism 39 for varying the pitch of tail rotor blades 17. Tail rotor 2 is rotated about transverse tail rotor axis 19 by a drive linkage interconnecting engine 3 and tail rotor 2 to generate a thrust force transverse to the tail boom 16 and offset from the vertical axis of rotation 9 of the main rotor 1. The magnitude of the thrust force can be varied by varying the collective pitch of tail rotor blades 17 to cause helicopter 15 to turn about vertical axis 9 so that it will head in a particular direction. Reference is hereby made to U.S. Pat. No. 5,305,968 to Paul E. Arlton, which is hereby incorporated by reference herein, for a description of a suitable device for operating a tail rotor to automatically stabilize the yaw motion of a helicopter.

Figure 2:
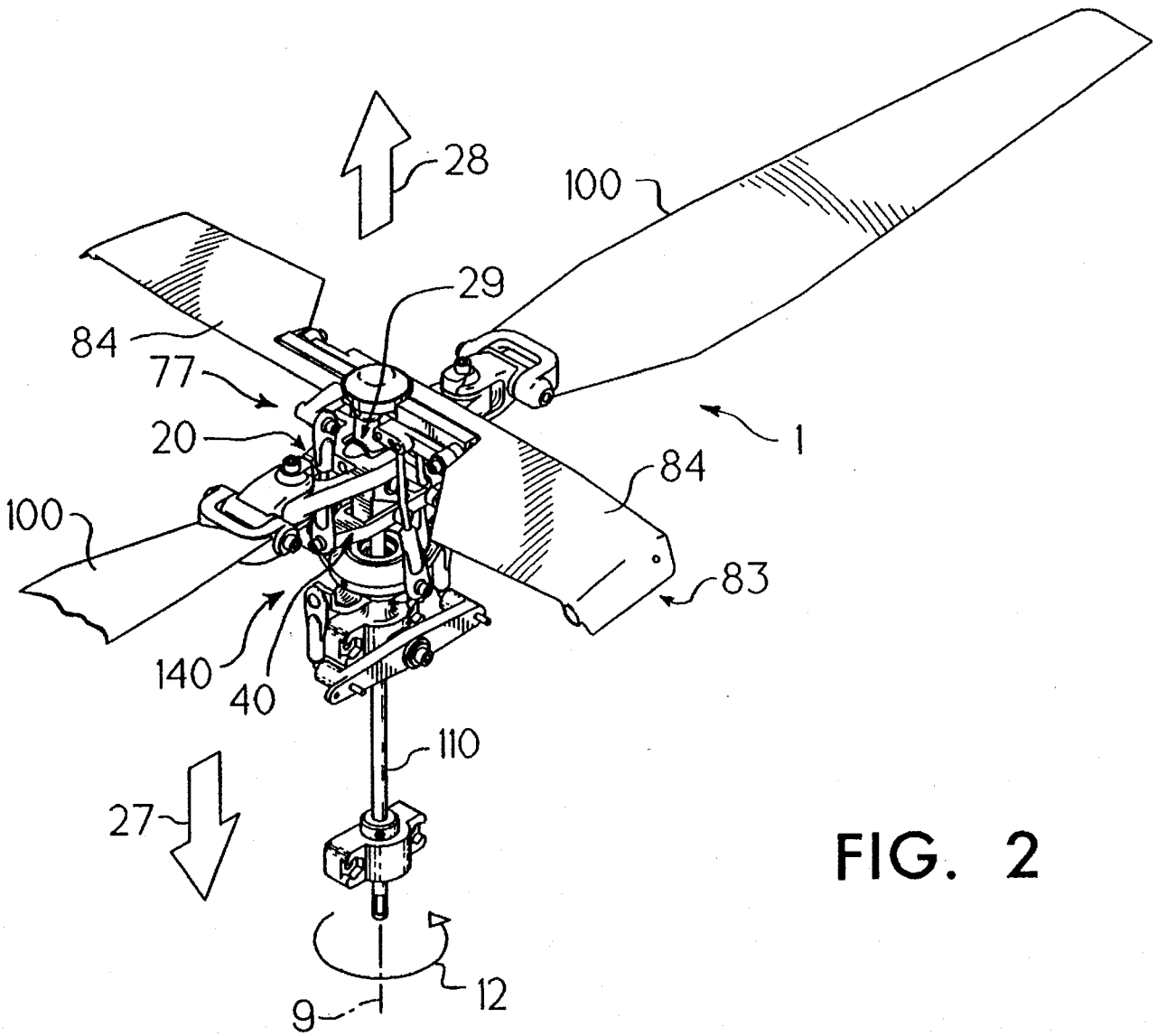
FIG. 2 is an enlarged perspective view of the main rotor system of FIG. 1 with all other parts of the helicopter removed for clarity.

Referring now to FIG. 2, in operation, engine 3 causes main rotor 1 to rotate rapidly about shaft axis 9 on rotor shaft 110 in rotor rotation direction 12. As it does so, rotor blades 100 and subrotor blades 84 act like propellers or fans moving large amounts of air in downward direction 27, thereby creating a force that lifts helicopter 15 upward in direction 28. In order to control helicopter 15 in horizontal flight, the pilot causes rotating main rotor 1 to tilt slightly in one direction or another relative to rotor shaft 110. The offset lift force produced by the tilted main rotor causes the helicopter to move horizontally in the direction of the tilt.

Since main rotor 1 on helicopter 15 rotates while the fuselage or body 4 of the helicopter 15 does not, some mechanism is needed to transmit control commands from the non-rotating pilot to rotating main rotor 1. One such mechanism is swashplate 140 which is essentially a large ball bearing assembly surrounding main rotor shaft 110. In order to tilt main rotor 1, the pilot moves linkages attached to swashplate 140 which in turn are connected through linkages to rotor blades 100 and subrotor blades 84. The lower portion of swashplate 140 is attached to the helicopter fuselage structure and does not rotate with main rotor 1, while the upper portion is connected to and rotates with main rotor 1.

Subrotor blades 84 serve a triple purpose. As part of the main rotor control system they amplify pilot control commands to main rotor blades 100. As part of the stability system they act to keep main rotor 1 spinning in a constant plane in space. As rotor blades they can produce lift that reduces or eliminates the reversed flow commonly found near main rotor hub 29. Subrotor blades 84 can be used on any rotor system to reduce reversed flow around the hub area.

Figure 3:
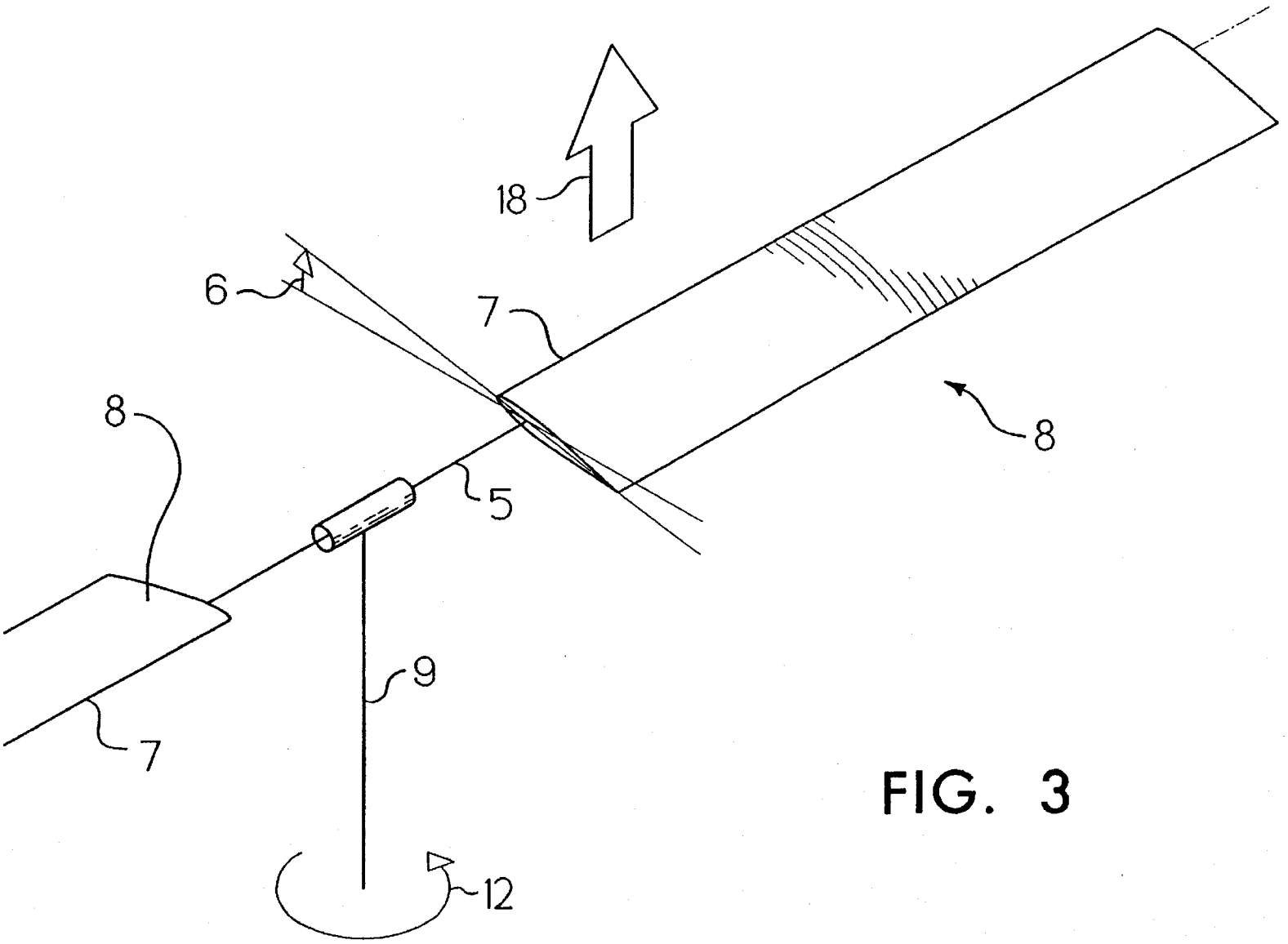
FIG. 3 is a schematic representation of a simplified main rotor blade.

To understand generally how helicopter main rotor systems work, it is easiest to begin with a simplified representation of a rotor system. Referring now to FIG. 3, a schematic rotor blade 8 rotating in the sense of rotation direction 12 about shaft axis 9 has a pitch axis 5 running horizontally down the length of rotor blade 8. As shown by vertical pitch arrow 6, blade pitch (also called "angle-of-attack") is considered positive when leading edge 7 of rotor blade 8 is rotated upward in direction 18 about pitch axis 5. The aerodynamic lifting force produced by a rotor blade is related to blade pitch. Increased (positive) pitch corresponds to increased lift.

Figure 4:
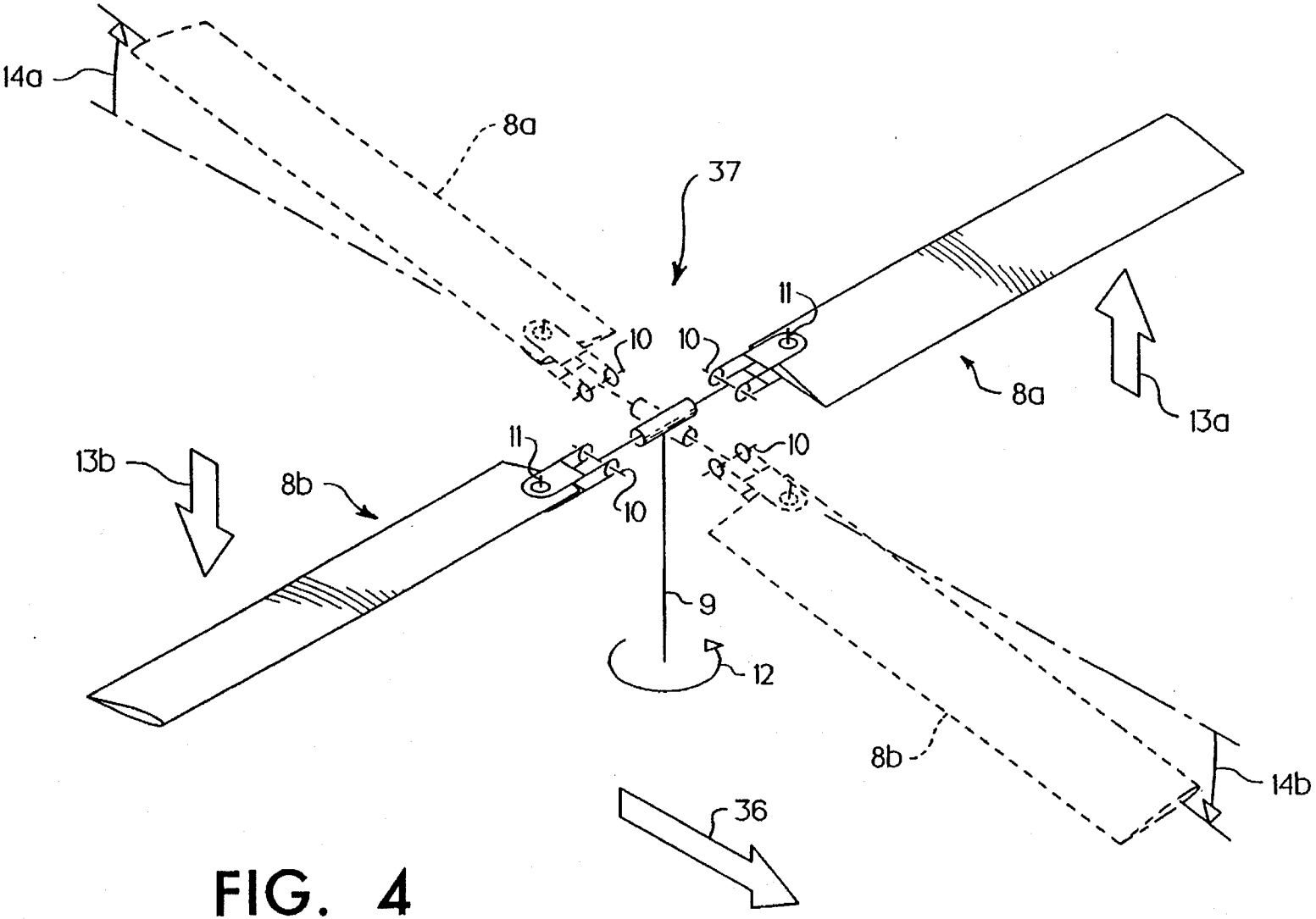
FIG. 4 is a schematic representation of a main rotor blade with flapping and lead-lag hinges.

As shown in FIG. 4, in addition to a pitch axis, rotor blades are generally hinged near rotor hub area 37 to allow each rotor blade to flap up and down about flapping hinge 10, and swing forward and backward on lead/lag hinge 11. Hinges 10 and 11 allow the rotor blades 8 to react to the constantly changing aerodynamic and gyroscopic forces encountered in flight. Without hinges 10 and 11, the rotor blades 8 would have to be built stronger and heavier to withstand in-flight forces.

Helicopter dynamics are substantially different from airplane dynamics. The rotating main rotor on top of a helicopter acts like an immense gyroscope. As such, the main rotor obeys the physical laws of gyroscopes which are not intuitively obvious. A rule of thumb can help one to remember how gyroscopes operate: force applied to a rotating gyroscope produces motion 90 degrees later in the direction of rotation. For example, as shown in FIG. 4, if an "aerodynamic force" 13*a* is applied to rotor blade 8*a* rotating rapidly in rotation direction 12, rotor blade 8*a*, acting under the laws of gyroscopes, will flap upward 90° later in the direction of rotation 12 at 14*a*. Likewise, if a different aerodynamic force 13*b* is applied to rotor blade 8*b*, as also shown in FIG. 4, then rotor blade 8*b* will flap downward 90° later in the direction of rotation 12 at 14*b*. This flapping will be seen by an observer as a tilt of the entire main rotor "disk." (When a rotor rotates at high speed, it is difficult for an observer to discern individual rotor blades; the rotor appears as a transparent disk. As a consequence, a rotating rotor is typically referred to as a rotor disk.) It will be understood by those skilled in the art that an aerodynamic force such as 13*a* or 13*b* can be either (1) an external force created by unplanned gusts of wind or other environmental factors, or (2) a force created by a planned change in pitch of a single rotor blade controlled by the helicopter pilot.

Traditionally, the pilot of a full-size helicopter controls the main rotor by manipulating a joystick called the "cyclic" control located in front of the pilot and a lever called the "collective" control located to the left of the pilot. Cables, push-pull rods, and bellcranks connect the cyclic and collective controls through the swashplate to the pitch controls of the main rotor blades.

Main rotor systems of most radio-controlled model helicopters operate in an manner similar to full-size helicopters. The pilot manipulates small joysticks on a hand-held radio transmitter which in turn sends commands to electromechanical servo actuators located within the flying model. Push-pull rods and bellcranks connect the servos through the swashplate to the pitch controls of the main rotor blades.

To bank the helicopter to the right or left, or move forward or backward, rotating rotor blades 8 are pitched upward as they pass around one side of the helicopter and then downward as they pass around the other in accordance with the techniques shown diagrammatically in FIG. 4. This is called "cyclic" pitching since the rotor blades cycle up and down as the rotor rotates. The difference in lift produced on either side of the helicopter causes the main rotor blades to flap up and down, and the rotor disk appears to tilt. The tilted rotor disk produces a lateral thrust force which then pushes the helicopter in the direction of the tilt (e.g., in direction 36 in the diagrammatic view shown in FIG. 4).

The large size and high inertia of helicopter rotors means that they cannot change speed quickly. For this reason, they are usually designed to operate at a nearly constant rotational speed throughout all flight regimes. To control main rotor lift, the main rotor blades are pitched upward or downward in unison. Since all rotor blades move together this is called "collective" pitching. The change in pitch, and associated lift force, of the rotating main rotor blades causes the helicopter gain or loose altitude.

Some small model helicopters rely on variable engine speed instead of collective blade pitch for altitude control since main rotor thrust is proportional to engine speed as well as blade pitch. The main rotor blades on these models are typically built at a fixed pitch (relative to each other) and are light enough to react quickly to changes in engine speed. The primary advantage of fixed-pitch rotors on models is reduced mechanical complexity. The preferred embodiment of the present invention is of the fixed-pitch variety, but may be generalized to collective-pitch rotors.

Flight stability is often a problem for small helicopters. To augment stability, weighted stabilizer bars are usually incorporated into model helicopters, but are uncommon on modern full-size helicopters. First patented by Hiller in 1953 and refined for use on models by Shlüter in 1970, these flybars are tipped with aerodynamic paddles (Hiller paddles), and are connected through linkages to the swashplate and main rotor blades.

Hiller control systems naturally exhibit a slight control delay. A hybrid stabilization system called the Bell/Hiller system incorporates additional linkages to mix pilot control inputs with flybar stabilization. The Bell/Hiller system responds quickly to pilot control since control commands are transmitted directly to the main rotor blades, while the system is stabilized by a Hiller-type flybar and paddles.

A major drawback of flybars and paddles is increased aerodynamic drag. The circular cross-section flybar wire supporting Hiller paddles can produce drag as high or higher than that produced by the paddles. Moreover, since Hiller paddles are typically configured to operate at a zero (geometric) angle of attack, and since air passing through the rotor is almost always flowing downward, Hiller paddles can actually operate at a negative angle of attack with respect to the incoming airflow. In this way, Hiller paddles may actually contribute negative lift tending to push the helicopter downward toward the ground in opposition to the positive lift created by the main rotor.

A main rotor system for helicopters in accordance with the present invention employs unique aerodynamics and pitching, flapping and lead/lag configurations and mechanisms which significantly improve stability, durability, and manufacturability of the main rotor system. To develop a detailed understanding of the invention, it is easiest to view certain elements of the main rotor system separated from the system as a whole as shown in FIGS. 5–17.

Figure 5:
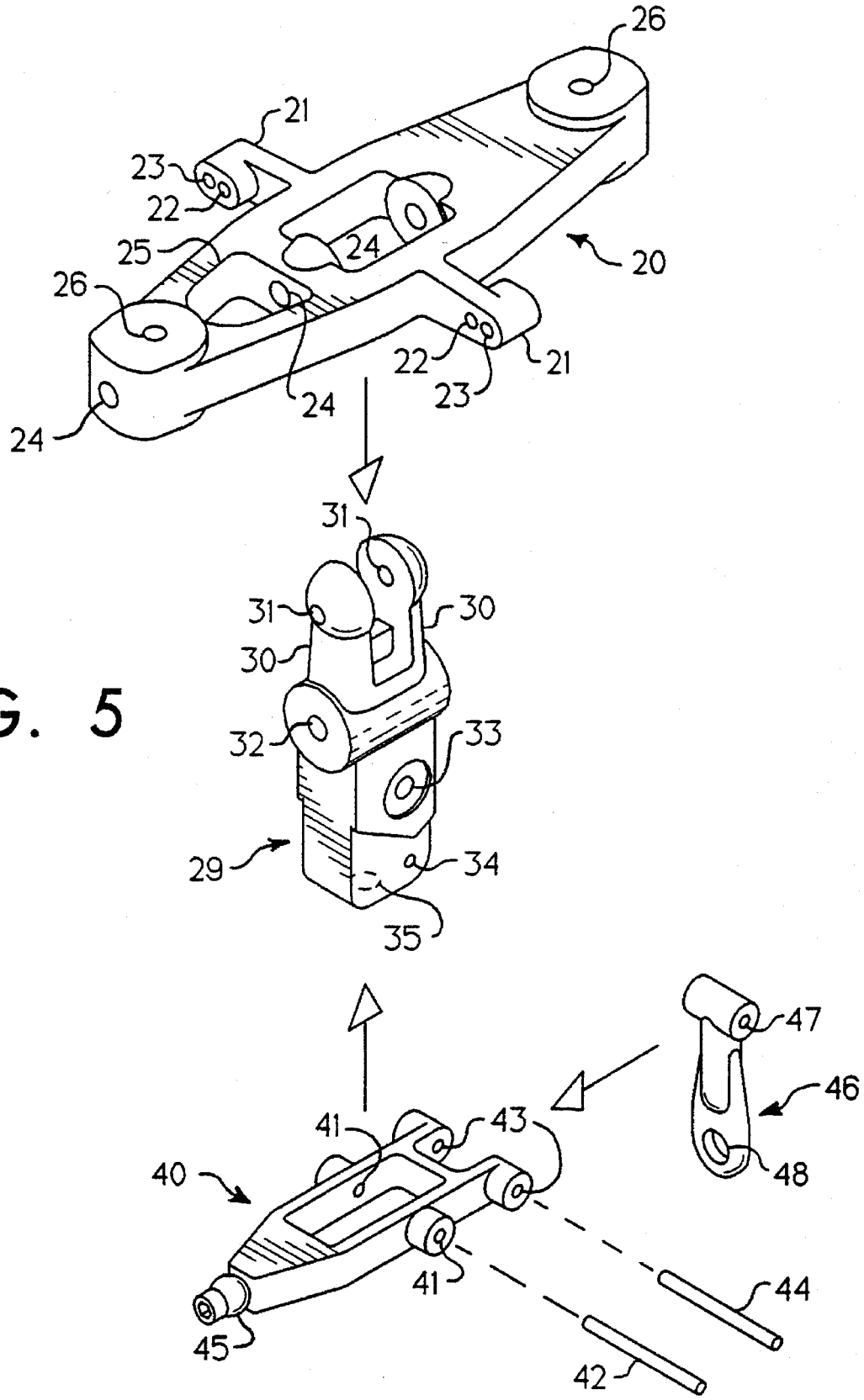
FIG. 5 is an exploded perspective view of hub parts included in the main rotor system of FIGS. 1 and 2 showing details of the hub parts prior to assembly, with all other parts omitted for clarity.

In accordance with a preferred embodiment of the present invention and referring now to FIG. 5, a rotor hub assembly 77 which forms the center of main rotor 1 is shown. Rotor hub assembly 77 is mounted in a position underneath the subrotor blades 84 between the main rotor blades 100 as shown best in FIGS. 1 and 2. Rotor hub assembly 77 includes pitch plate 20, rotor hub 29, and follower arm 40. Pitch plate 20 includes pitch arms 21 with pitch plate inner and outer Z-link holes 22 and 23, pitch-pin through-holes 24, pitch plate lead/lag holes 26, and link clearance opening 25. Rotor hub 29 includes hub teeter posts 30, hub teeter-pin holes 31, hub pitch-pin hole 32, shaft bolt hole 33, hub pivot-pin hole 34, and rotor shaft hole 35 exiting the bottom surface. Follower arm 40 includes follower pivot-pin holes 41 for follower pivot-pin 42, follower arm link-pin holes 43 for follower link-pin 44, and follower ball link 45. Follower link 46 includes follower link pin hole 47 and follower link ball-socket 48.

Figure 6:
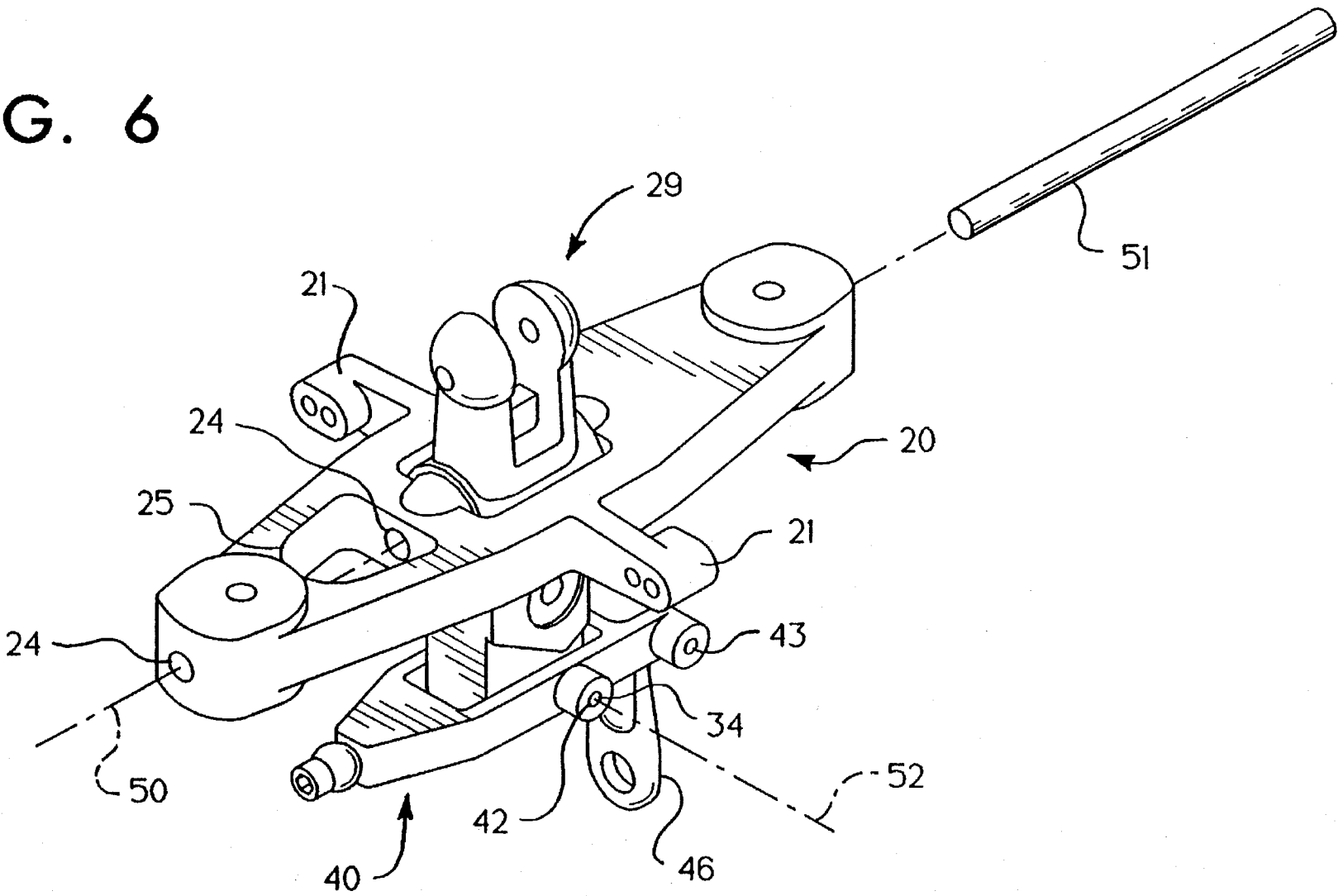
FIG. 6 is a perspective view of the main rotor system hub parts of FIG. 5 showing details after partial assembly, with all other parts omitted for clarity.

Once assembled, as shown in FIG. 6, pitch plate 20 is pivotably supported by rotor hub 29 and constrained to rotate about pitch axis 50 by pitch pin 51. During assembly, pitch pin 51 is slid through pitch-pin through-holes 24 in pitch plate 20 and forceably pressed into slightly undersized hub pitch-pin hole 32 in rotor hub 29. Pitch pin 51 extends through rotor hub 29 until flush with link clearance opening 25 in pitch plate 20. Follower arm 40 is pivotably mounted to rotor hub 29 and constrained to pivot about follower arm pivot axis 52 by follower arm pivot-pin 42. Follower arm pivot-pin 42 is forceably pressed into slightly undersized hub pivot-pin hole 34 in rotor hub 29. Similarly, follower link 46, is operably connected to follower arm 40 with follower link-pin 44 extending through follower link pin hole 47.

Figure 7:
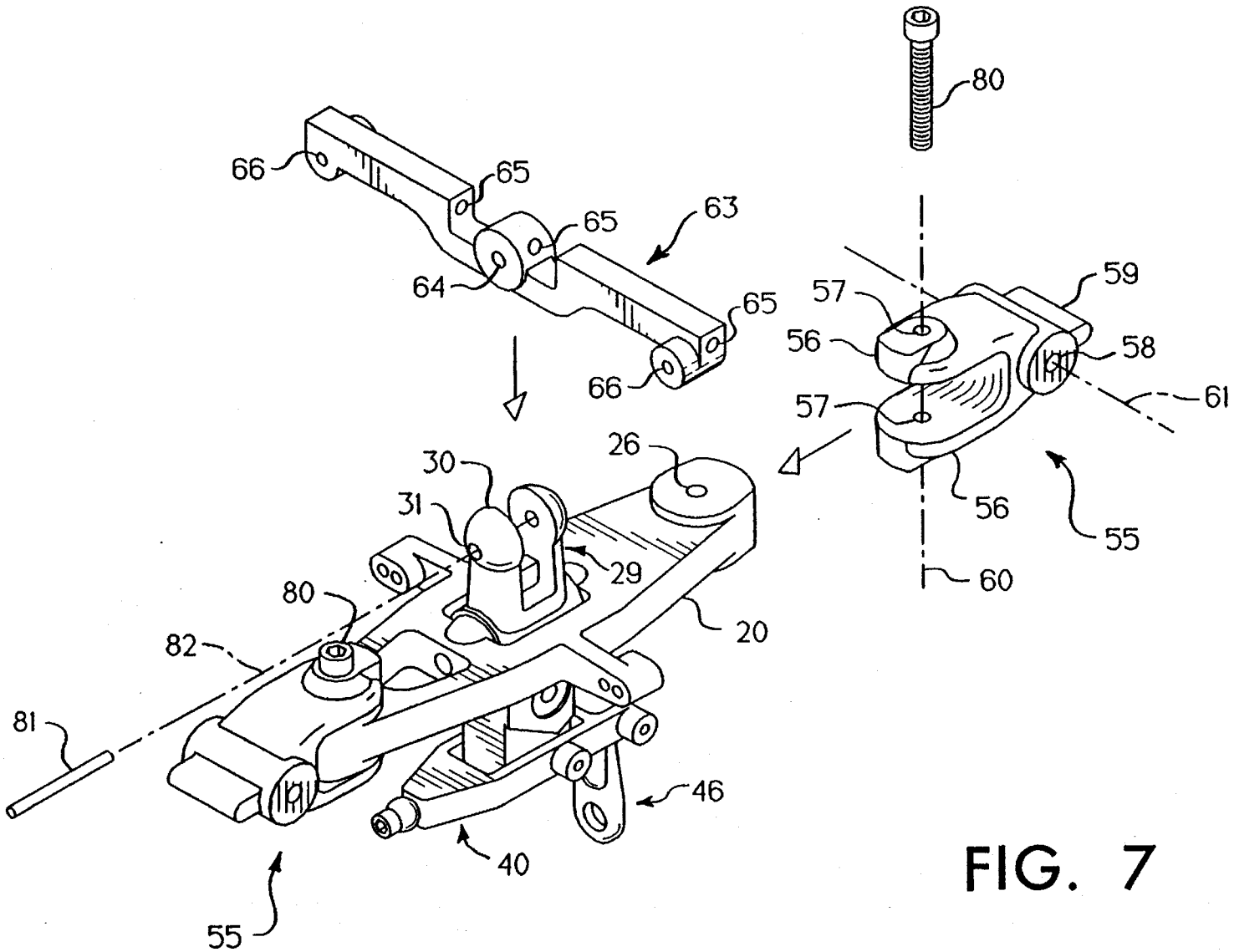
FIG. 7 is an exploded perspective view of the hub assembly of the main rotor system showing the rotor blade-grip and teeter attachment as they would appear before being mounted on the hub assembly, with all other parts omitted for clarity.
Figure 8:
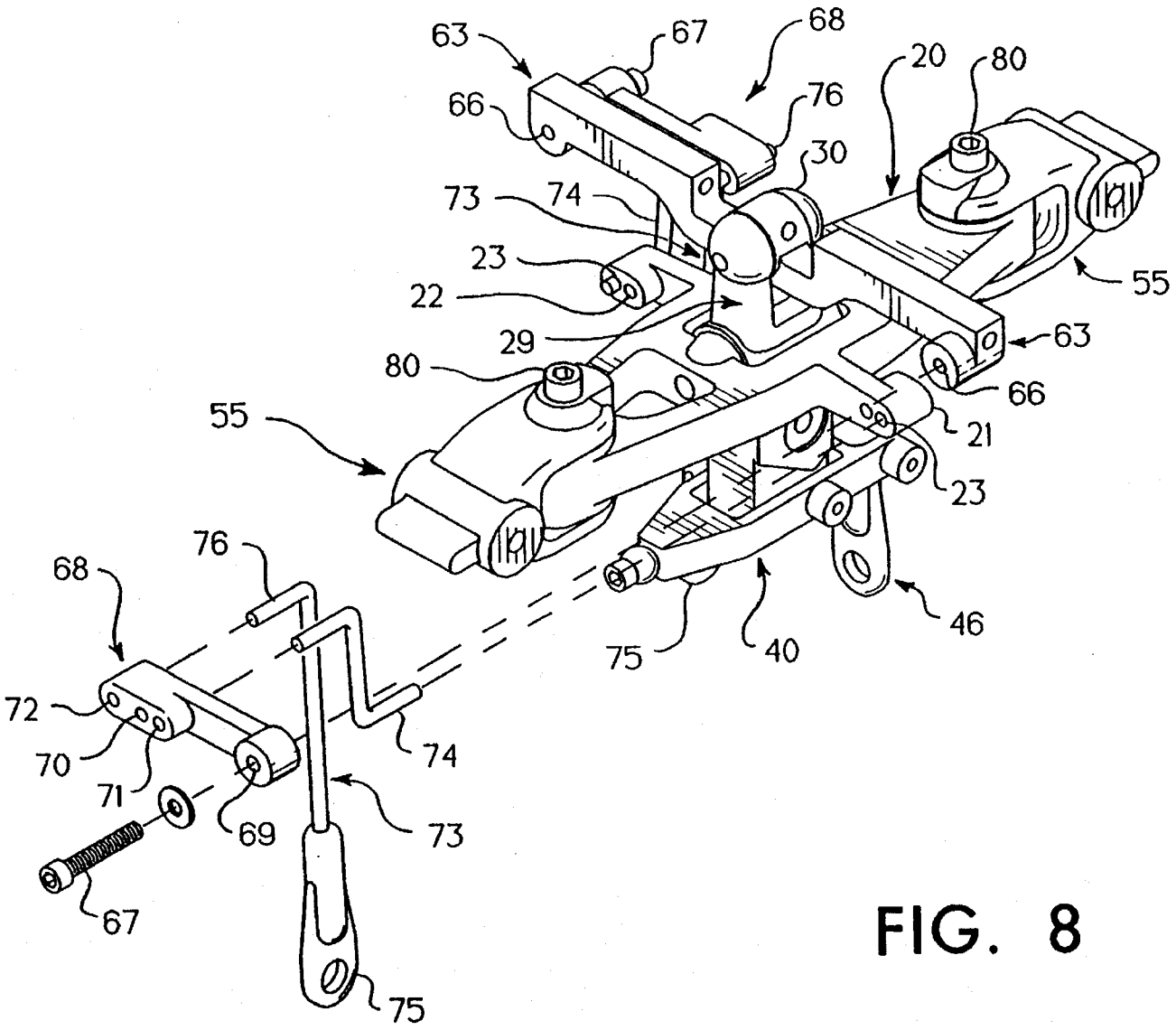
FIG. 8 is an exploded perspective view of the hub assembly of the main rotor system showing the components of the mixing arm link attachment before they are mounted on the hub assembly, with all other parts omitted for clarity.
Figure 10:
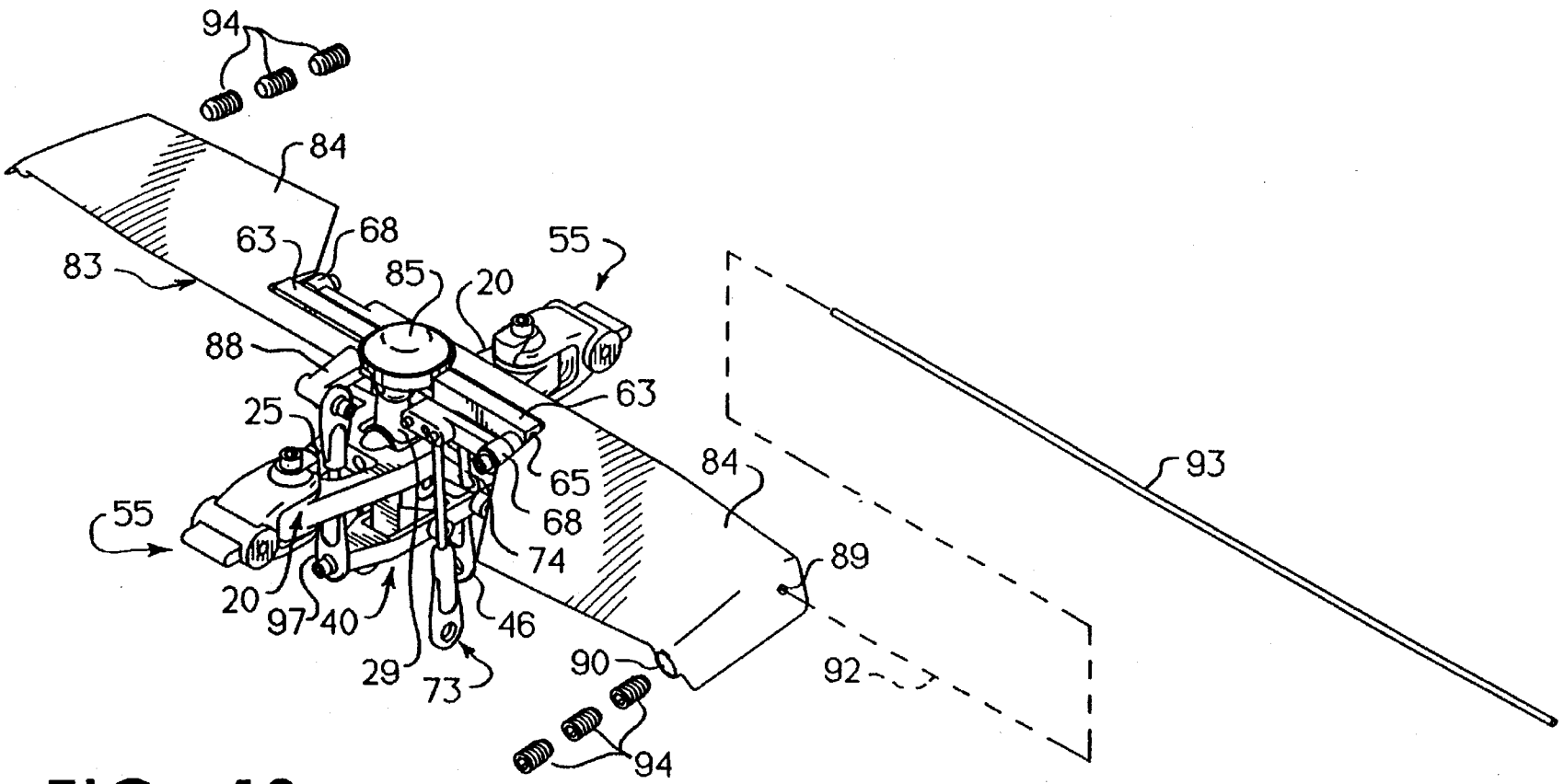
FIG. 10 is a view similar to FIG. 9 showing the subrotor after partial assembly onto the hub assembly, with all other parts omitted for clarity.

Now considering FIG. 7 and FIG. 8, a teeter 63 is pivotably mounted to the top of rotor hub 29. The teeter 63 is provided for supporting subrotor blades 84 as shown in FIG. 10. Teeter 63 is formed to include teeter pin hole 64, teeter through-holes 65, and teeter mixing-arm bolt holes 66 sized to receive mixing arm bolts 67. As will become apparent, once subrotor 83 is mounted on teeter 63, subrotor pitch axis 92 (see FIG. 10) is a line passing through teeter through-holes 65.

Figure 19:
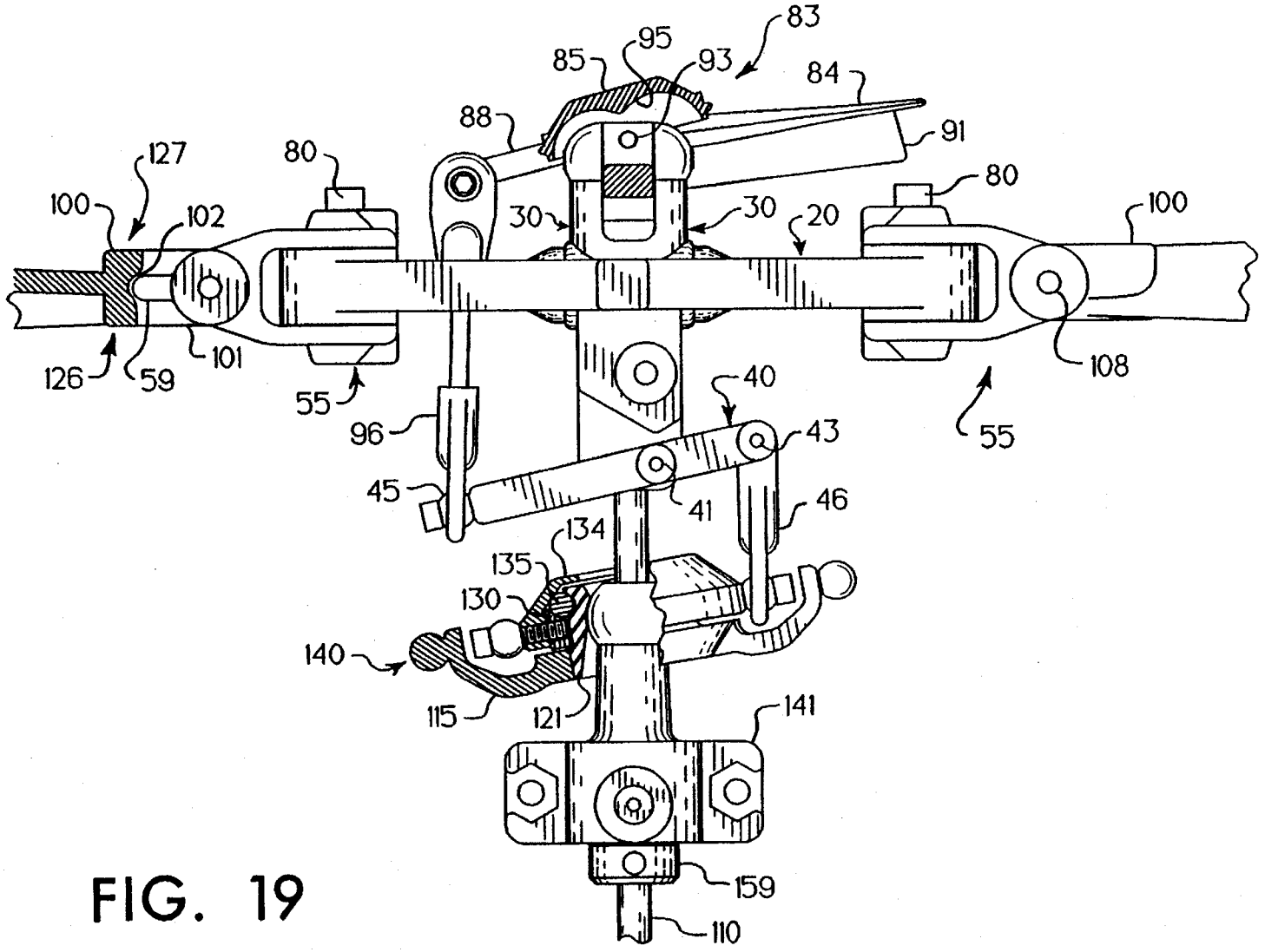
FIG. 19 is a side elevation view of the main rotor system of FIG. 1 primarily showing operation of the subrotor control linkages to cause the subrotor blade to be pitched in response to tilting the swashplate, with portions of the swashplate, rotor blade, and subrotor shown in cross section, and all other parts omitted for clarity.

Blade grips 55 are provided on pivot plate 20 to support main rotor blades 100 as shown in FIG. 19. Referring to FIGS. 7 and 8, blade grips 55 include upper and lower grip fingers 56, flapping limit-tab 59, blade grip lead/lag holes 57 defining lead/lag axis 60, and blade grip flapping hole 58 defining flapping axis 61. Blade grips 55 are pivotably secured to pitch plate 20 by lead/lag bolts 80 which extend through and are secured against rotation in blade grip lead/lag holes 57 and freely rotate within pitch plate lead/lag holes 26.

Two mixing arms 68 are mounted on teeter 63 as shown in FIG. 8, and each mixing arm 68 is formed to include a mixing arm bolt hole 69, a mixing arm swashplate-link hole 72, and mixing arm inner and outer Z-link holes 70 and 71 for novel Z-links 74. Swashplate links 73 terminate in swashplate link ball-socket 75 and swashplate link elbow 76. Mixing arms 68 are pivotably secured to teeter 63 by mixing arm bolts 67 which extend through mixing arm bolt holes 69 and are secured against rotation in teeter mixing-arm bolt holes 66. Teeter 63 is pivotably supported by hub teeter posts 30 and constrained to rotate about teeter axis 82 by teeter pin 81 after teeter pin 81 is slid through hub teeter pin holes 31 in hub teeter posts 30 and forceably pressed through slightly undersized teeter pin hole 64 in teeter 63. Z-links 74 operably connect mixing arm outer Z-link holes 71 and pitch plate outer Z-link holes 23 for standard control authority, or mixing arm inner Z-link holes 70 and pitch plate outer Z-link holes 22 for boosted control authority. Advantageously, novel Z-links 74 are substantially less expensive and more compact than traditional ball-joints employed in most main rotor systems.

Figure 9:
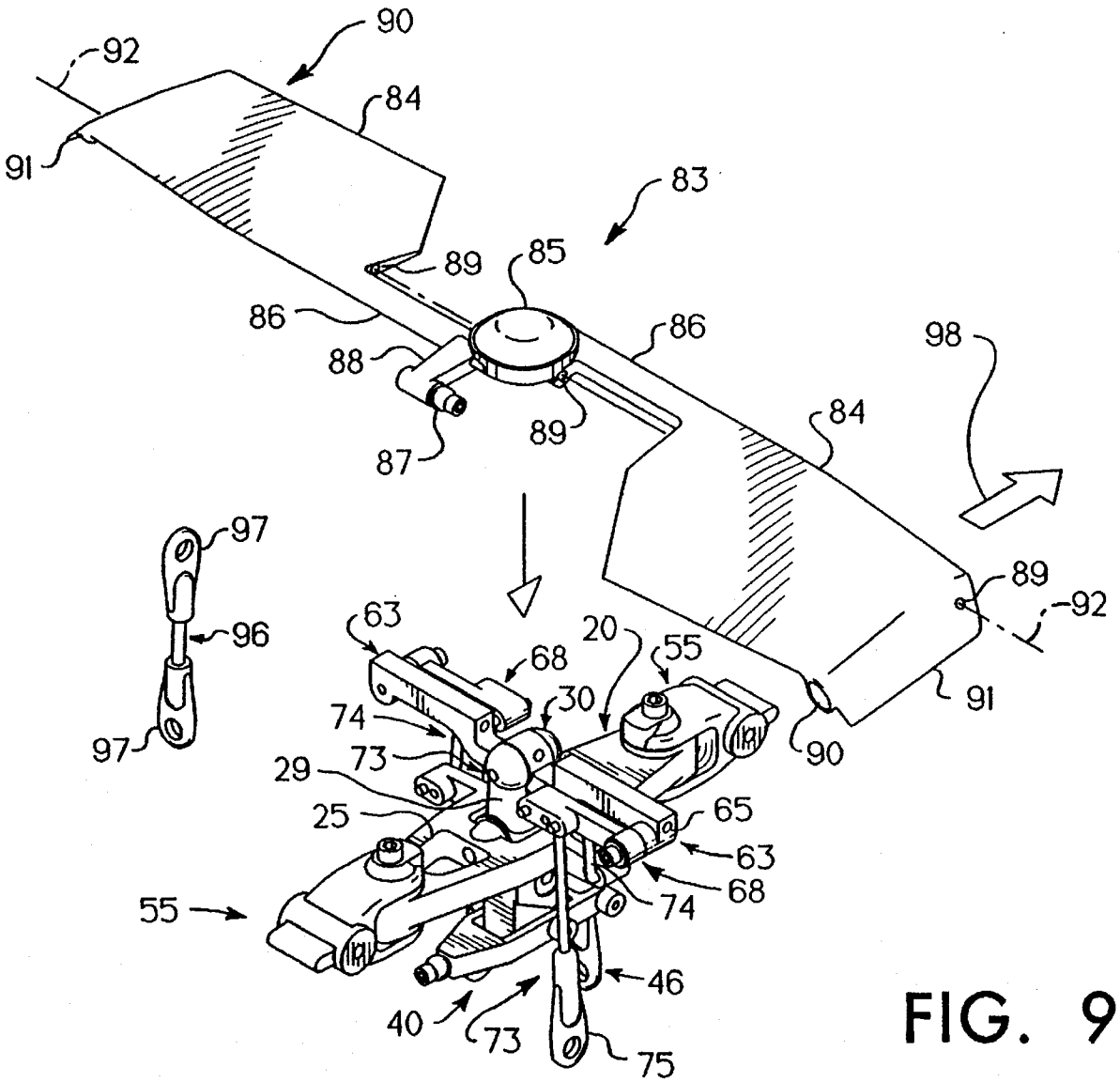
FIG. 9 is an exploded perspective view of the hub assembly of the main rotor system showing the subrotor as it appears before it is mounted on the hub assembly, with all other parts omitted for clarity.

Referring now to FIG. 9, subrotor 83 comprises airfoiled subrotor blades 84 fixedly connected to subrotor cap 85 by subrotor blade extensions 86. Subrotor blades 84 are generally pitched to a positive angle of attack and extend substantially inboard from the tips of subrotor 83. In the preferred embodiment, subrotor blades 84 are pitched upward 8 to 15 degrees. Subrotor rod through-holes 89 extend completely through subrotor blades 84 and subrotor cap 85 and intersect subrotor weight holes 90 in each subrotor blade 84. Subrotor pitch arm 88 is fixedly connected to one subrotor blade extension 86 and terminates in subrotor ball link 87. Subrotor angled tips 91 hide bulges containing subrotor weight holes 90. Subrotor pitch link 96 terminates in subrotor pitch-link ball-sockets 97.

In the preferred embodiment of the present invention, the chordwise location of subrotor through-hole 89 geometrically divides subrotor blades 84 so that less than 25% of the surface area of subrotor blades 84 lie ahead in direction of subrotor pitch axis 92. Subrotor 83 thereby tends to be pitch-convergent and insensitive to linkage slop.

As shown in FIGS. 7, 9, and 10, subrotor 83 is pivotably supported by teeter 63 and constrained by subrotor rod 93 to rotate about subrotor pitch axis 92 (defined by teeter through-holes 65) after subrotor rod 93 is slid through subrotor rod through-holes 89 in subrotor 83 and teeter through-holes 65 in teeter 63. Subrotor rod 93 is confined within subrotor 83 and teeter 63 by subrotor weights 94 which screw into subrotor weight holes 90 and occlude subrotor rod through-holes 89. Subrotor weights 94 also act to increase the gyroscopic stability of subrotor 83. Subrotor 83 is operably connected to follower arm 40 by pitch link 96 which passes through link clearance opening 25 in pitch plate 20. As shown in cutaway on FIG. 19, subrotor cap 85 has a generally concave surface 95 underneath to prevent interference with hub teeter posts 30.

Figure 11:
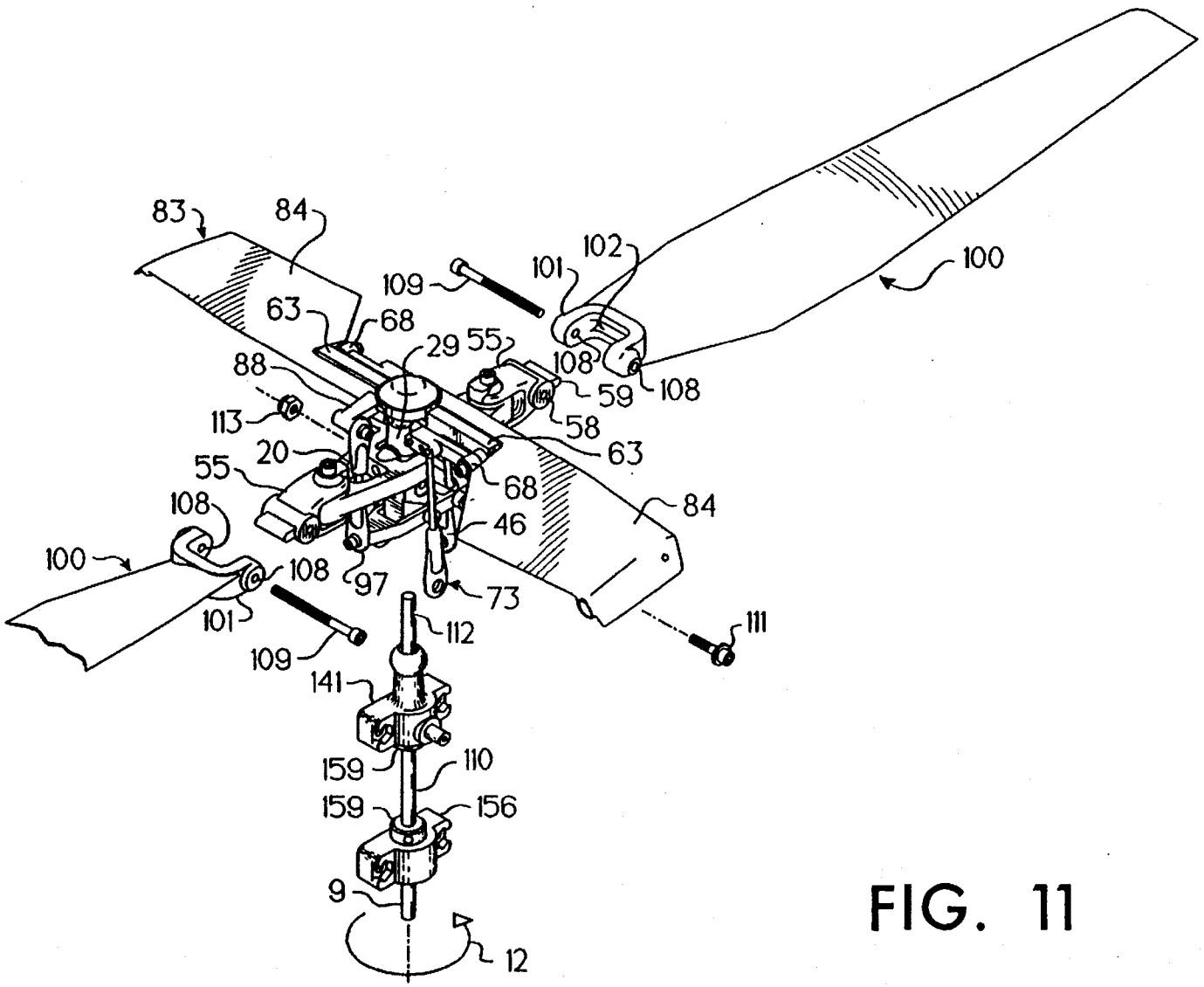
FIG. 11 is a view similar to FIG. 10 showing the rotor blade and rotor shaft attachment as they appear before they are installed on the hub and subrotor assembly, with all other parts omitted for clarity.

Proceeding to FIG. 11, rotor blades 100 have C-shaped blade root 101 incorporating flapping detent 102, and are pivotably secured to blade grips 55 by flapping bolts 109 which extends through and freely rotate within blade root flapping holes 108 and are secured against rotation in blade grip flapping holes 58. Flapping motion of rotor blade 100 is limited by flapping limit-tab 59 on blade grip 55 contacting upper and lower surfaces of flapping detent 102.

Figure 12:
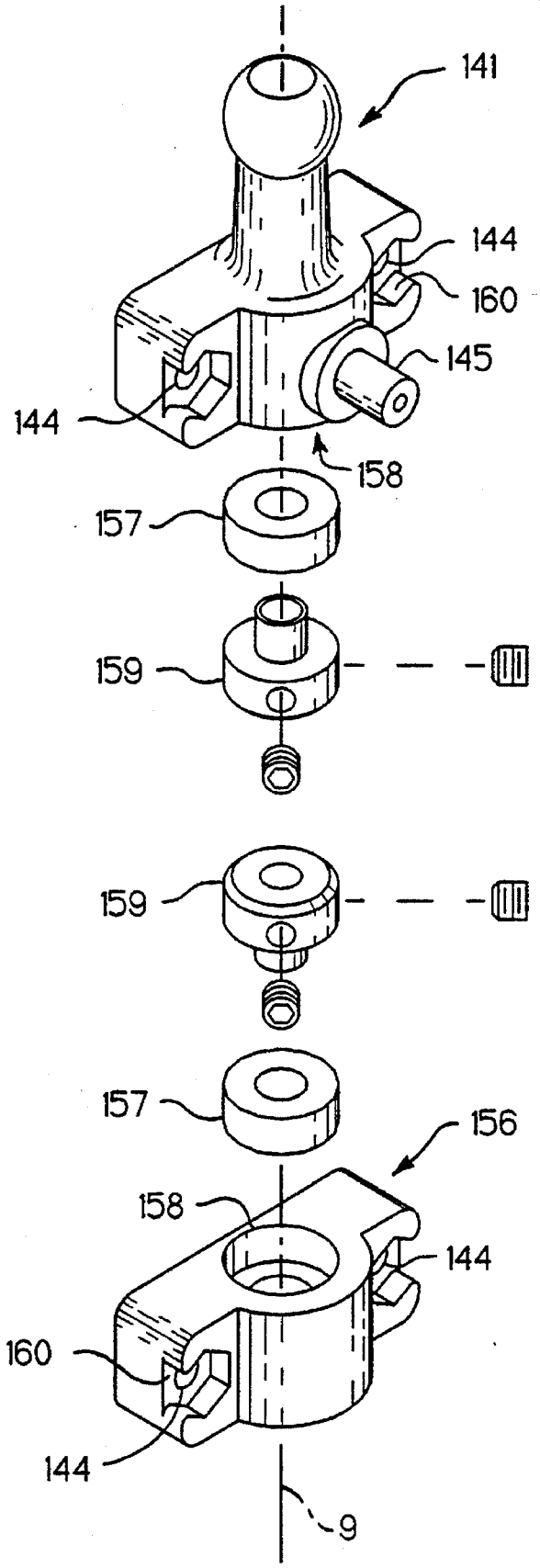
FIG. 12 is an exploded view of the upper and lower bearing support blocks included in the main rotor system and shown in FIGS. 2 and 11, with all other parts omitted for clarity.

FIG. 11 and FIG. 12 show upper bearing block 141 and lower bearing block 156 with bearing block nut recesses 160, and bearing recesses 158 on the bottom of upper bearing block 141 and on the top of lower bearing block 156 receptive to ball bearing units 157. Bearing retaining collars 159 retain ball bearing units 157 in bearing recesses 158 and adapt bearings to rotor shaft 110 extending along vertical axis 9.

Now referring to FIG. 5 and FIG. 11, rotor shaft 110 extends through retaining collars 159 in upper and lower bearing blocks 141 and 156, into shaft hole 35 in rotor hub 29, and is fixedly secured to rotor hub 29 by rotor hub bolt 111 passing through shaft bolt hole 33 and shaft notch 112 into hub locknut 113. Rotation of rotor shaft 110 about shaft axis 9 in rotor rotation direction 12 (as by an engine 3 within the fuselage 4 of a helicopter 15) rotates rotor hub 29 and all interconnected elements of the main rotor.

Figure 13:
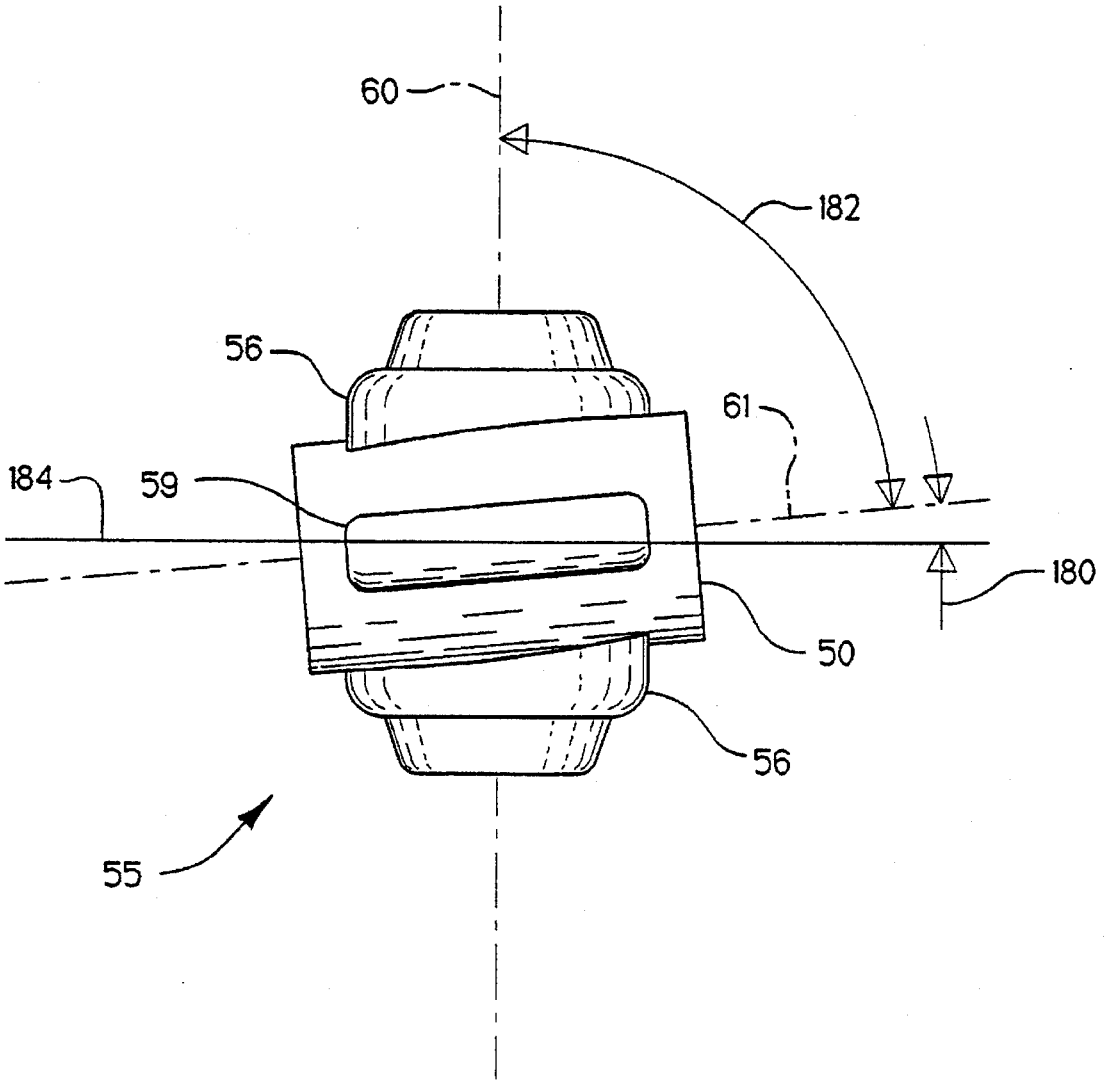
FIG. 13 is an end view of a blade grip illustrating relative orientation of flapping and lead-lag axes.
Figure 13A:
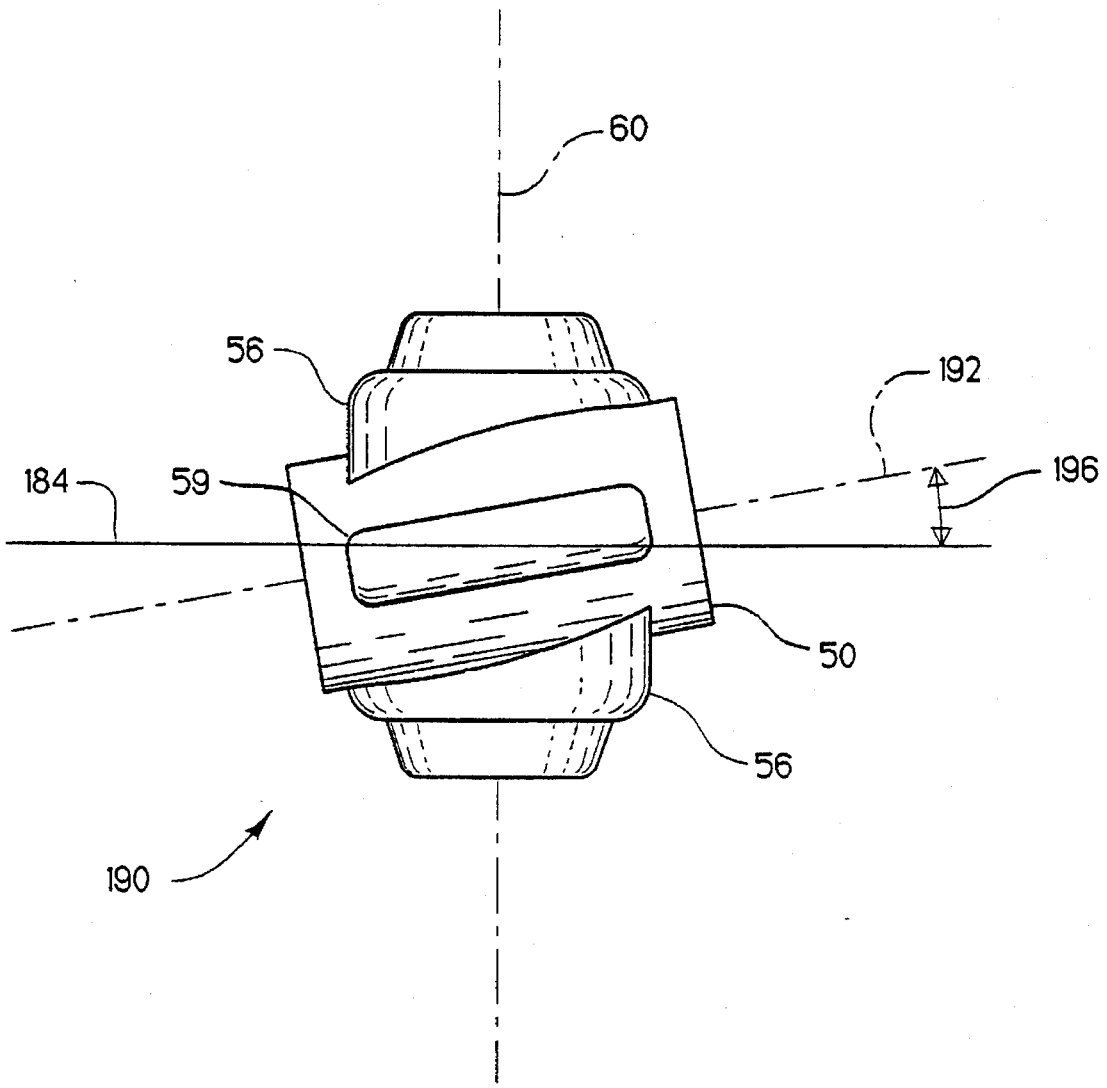
FIG. 13A is an end view of another interchangeable blade grip set at an angle other than 90° and different from the angle set in the blade grip of FIG. 13.

As shown in FIGS. 7, 11, and 13, lead/lag axis 60 and flapping axis 61 extending through blade grip 55 can be set at angles other than 90 degrees thereby defining any pitch of rotor blade 100. Collective blade pitch is adjusted by manually interchanging blade grips with different built-in pitch angles such as blade grip 55 having one built-in pitch angle 180 as shown, for example, in FIG. 13 and blade grip 190 having another built-in pitch angle 196 as shown in FIG. 13A.

As shown in FIG. 13, blade grip 55 is formed with a vertical lead/lag axis 60 and a flapping axis 61 set at an angle 182 of about 85 degrees from lead/lag axis 60 and thus at a built-in pitch angle 180 of about 5 degrees from a horizontal axis 184. Referring now to FIG. 11, each blade grip 55, therefore, contributes 5 degrees of pitch to a corresponding rotor blade 100 relative to pitch plate 20. A blade grip 55 may be removed from main rotor 1 (by manually removing the corresponding lead/lag bolt 80 as shown in FIG. 7 and flapping bolt 109 as shown in FIG. 11) and replaced with another blade grip formed with a flapping axis set to a built-in pitch angle different than that of blade grip 55. FIG. 13A shows a blade grip 190 formed with a flapping axis 192 set at a built-in pitch angle 196 other than 90° and different from the built-in pitch angle 180 of blade grip 55. When blade grip 55 is interchanged with blade grip 190, the pitch of rotor blade 100 is changed relative to pitch plate 20. The pitch of rotor blade 100 can be adjusted to any desired angle by manually interchanging blade grips having different built-in pitch angles.

Figure 14:
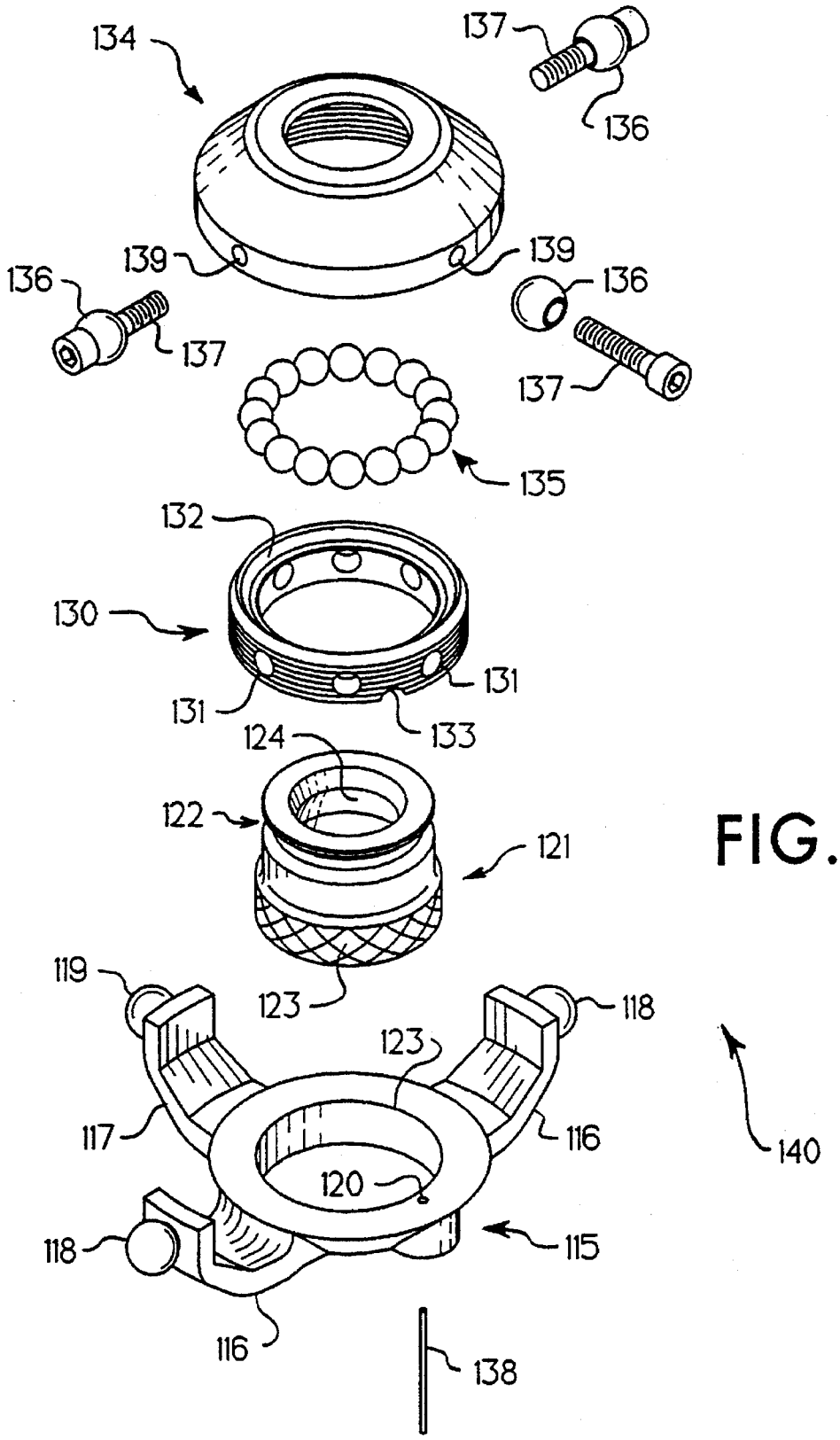
FIG. 14 is an exploded perspective view of the swashplate of the main rotor system of FIGS. 1 and 2.

To control the main rotor, pilot commands are transmitted through a swashplate 140 shown, for example, in FIGS. 1, 2, 18, and 19. As shown in FIG. 14, the swashplate 140 of the present invention includes swashplate arms 115, inner race sleeve 121, race ring 130, a plurality of ball bearings 135, outer race cap 134, swashplate ball-links 136, and race locking bolts 137. In the preferred embodiment of the current invention inner race sleeve 121, race ring 130, and outer race cap 134 are manufactured from aluminum alloy.

Swashplate arms 115 comprise fore-and-aft cyclic arms 116 terminating in fore-and-aft ball-links 118, roll arm 117 terminating in roll ball-link 119, and check-pin through-hole 120. Inner race sleeve 121 has circumferential inner race slot 122 receptive to ball bearings 135, and knurl pattern 123 externally, and is generally cylindrical with a semi-spherical top 124 internally. Race ring 130 includes a plurality of locking holes 131 and a ring notch 133, and is threaded about the exterior circumference. Race ring upper surface 132 is contoured to form the lower part of the outer race. Outer race cap 134 has a plurality of threaded holes 139, is contoured internally to form the upper part of the outer race, and is threaded about the interior circumference.

Figure 15:
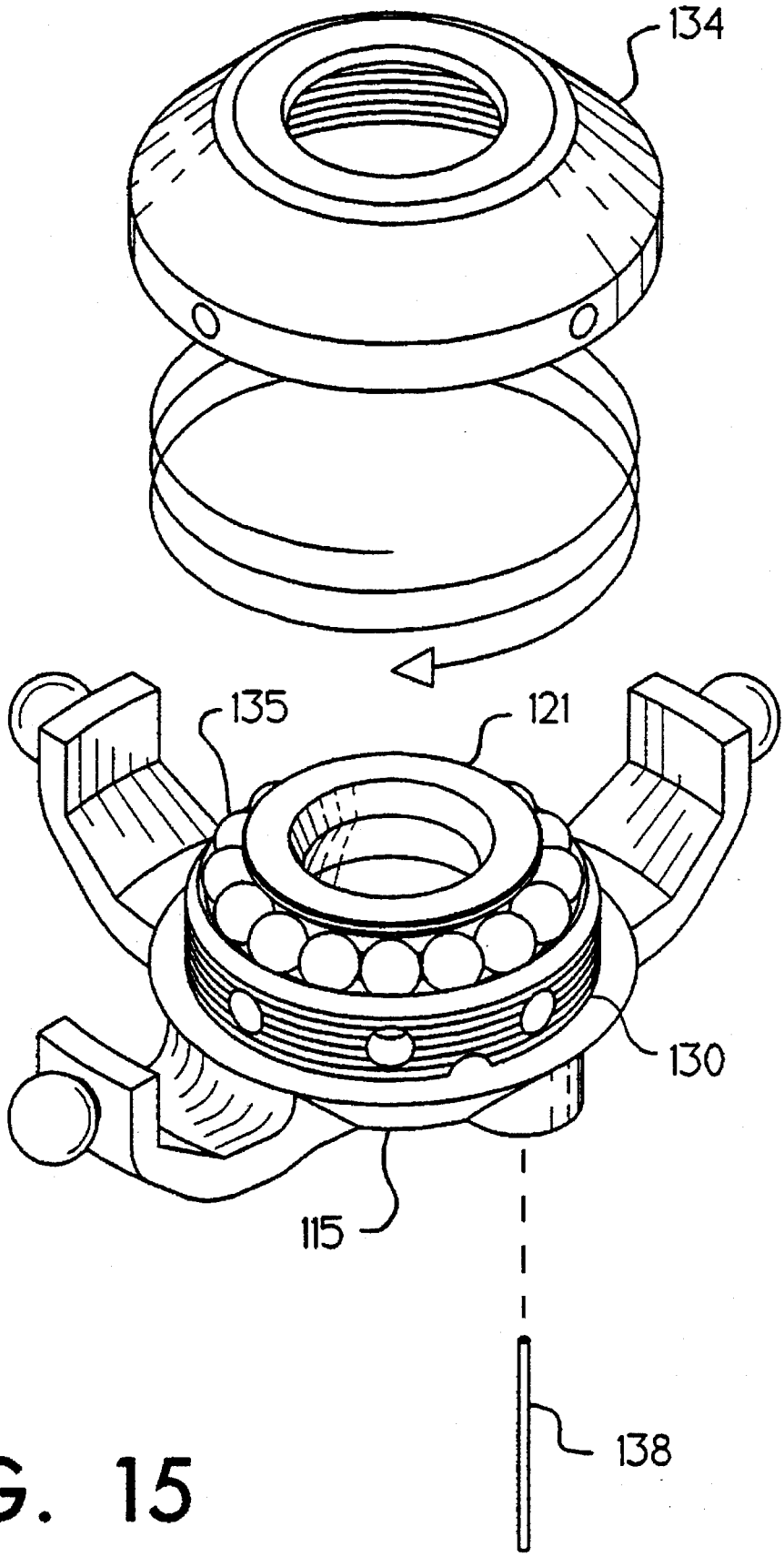
FIG. 15 is a view similar to FIG. 14 showing a ball-race adjustment suitable for use in the swashplate in accordance with the current invention.

Referring to FIGS. 14 and 15, in the preferred embodiment of the current invention, swashplate arms 115 are made of a plastics material such as nylon and are molded directly around knurl pattern 123 and are thereby permanently secured to inner race sleeve 121.

Figure 18:
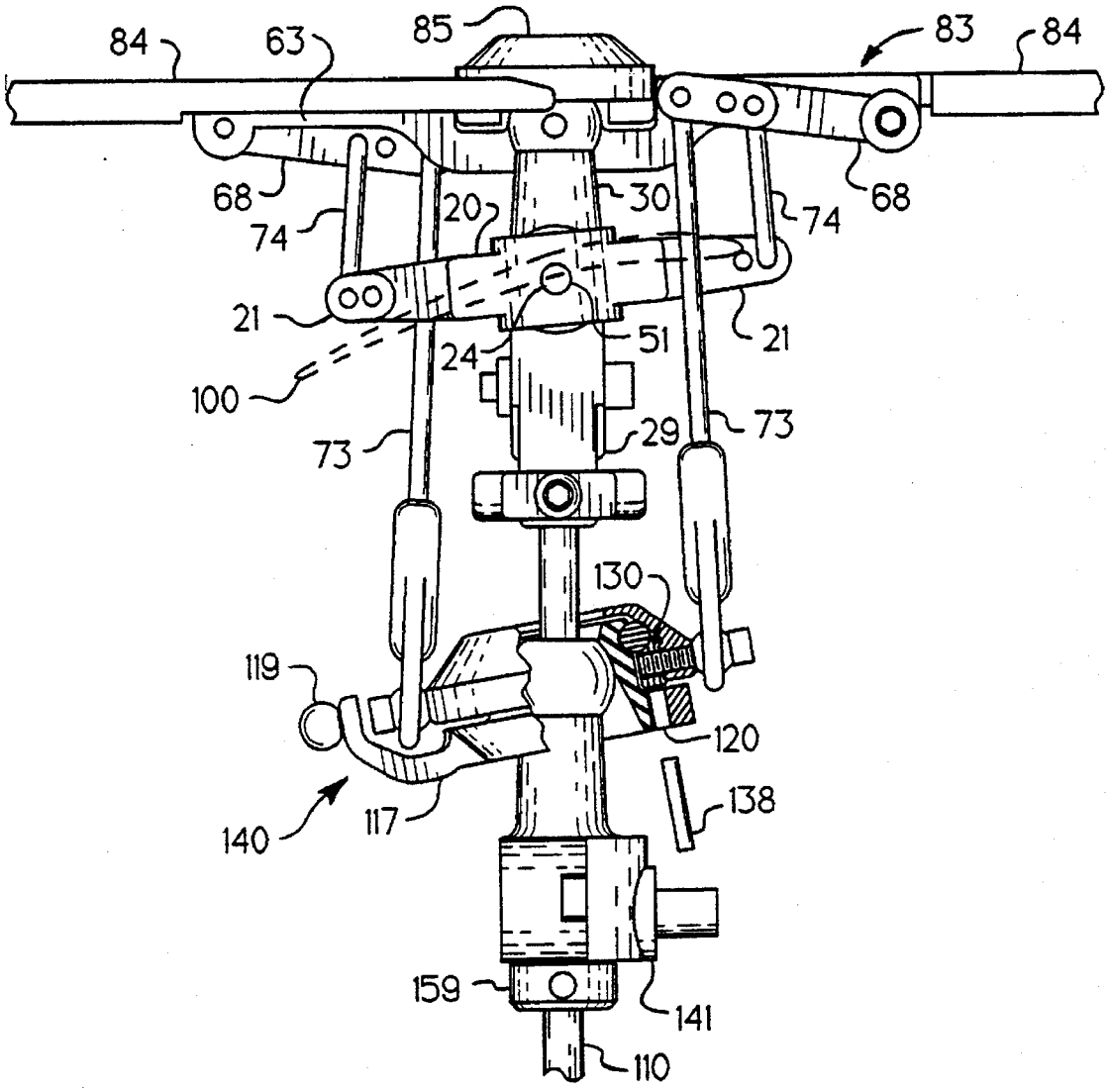
FIG. 18 is a side elevation view of the main rotor system of FIG. 1 primarily showing operation of the mixing arm control linkages, with portions of the swashplate shown in cross section to cause the main rotor blade to be pitched in response to tilting the swashplate, with all other parts omitted for clarity.

To assemble the swashplate 140, race ring 130 is slid over inner race sleeve 121 and the annular region formed by inner race slot 122 and race ring upper surface 132 is filled with a plurality of ball bearings 135. Alternatively, a single ball bearing assembly can be substituted for the plurality of ball bearings 135. Outer race cap 134 is screwed onto race ring 130 and the internal threads of outer race cap 134 engage the external threads of race ring 130. Check pin 138 is inserted temporarily through check-pin through-hole 120 to engage ring notch 133 and thereby prevent rotation of race ring 130 during assembly. Race ring 130 and outer race cap 134 are adjusted to assure smooth rolling of ball bearings 135. Race locking bolts 137 are inserted through swashplate ball-links 136 and threaded holes 139 to engage locking holes 131 thereby lock race ring 130 and outer ring cap 134 against relative rotation. Adjustments for ordinary wear are accomplished by removing race locking bolts 137 and readjusting race ring 130 and outer race cap 134. The cutaway portion of swashplate 140 illustrated in FIG. 18 shows location of check-pin through-hole 120 relative to race ring 130. Swashplate 140 can be used in any application where a compact, economical, adjustable ball bearing assembly would be beneficial.

Figure 16:
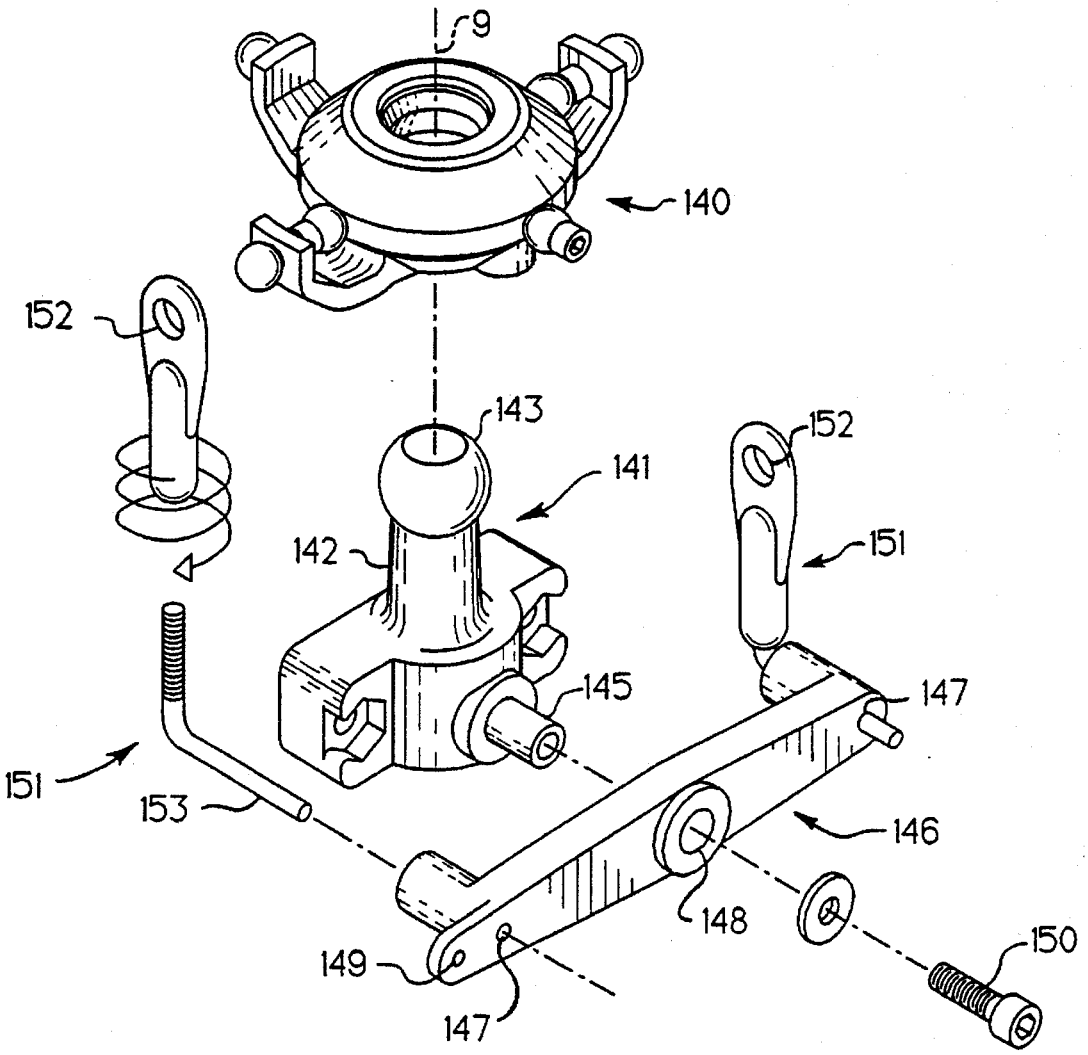
FIG. 16 is an exploded perspective view showing how the swashplate of FIG. 14 is mounted to the upper bearing block of FIGS. 11 and 12, with all other parts omitted for clarity.

In FIG. 16, upper bearing block 141 includes hold-down arm pivot 145 and a generally cylindrical hollow swashplate stalk 142 terminating in swashplate universal ball 143. Swashplate hold-down arm 146 has fore-and-aft cyclic link holes 147, hold-down arm pivot hole 148 and fore-and-aft control link hole 149. Adjustable fore-and-aft cyclic links 151 terminate in fore-and-aft link ball-socket 152 and fore-and-aft link elbow 153.

Figure 17:
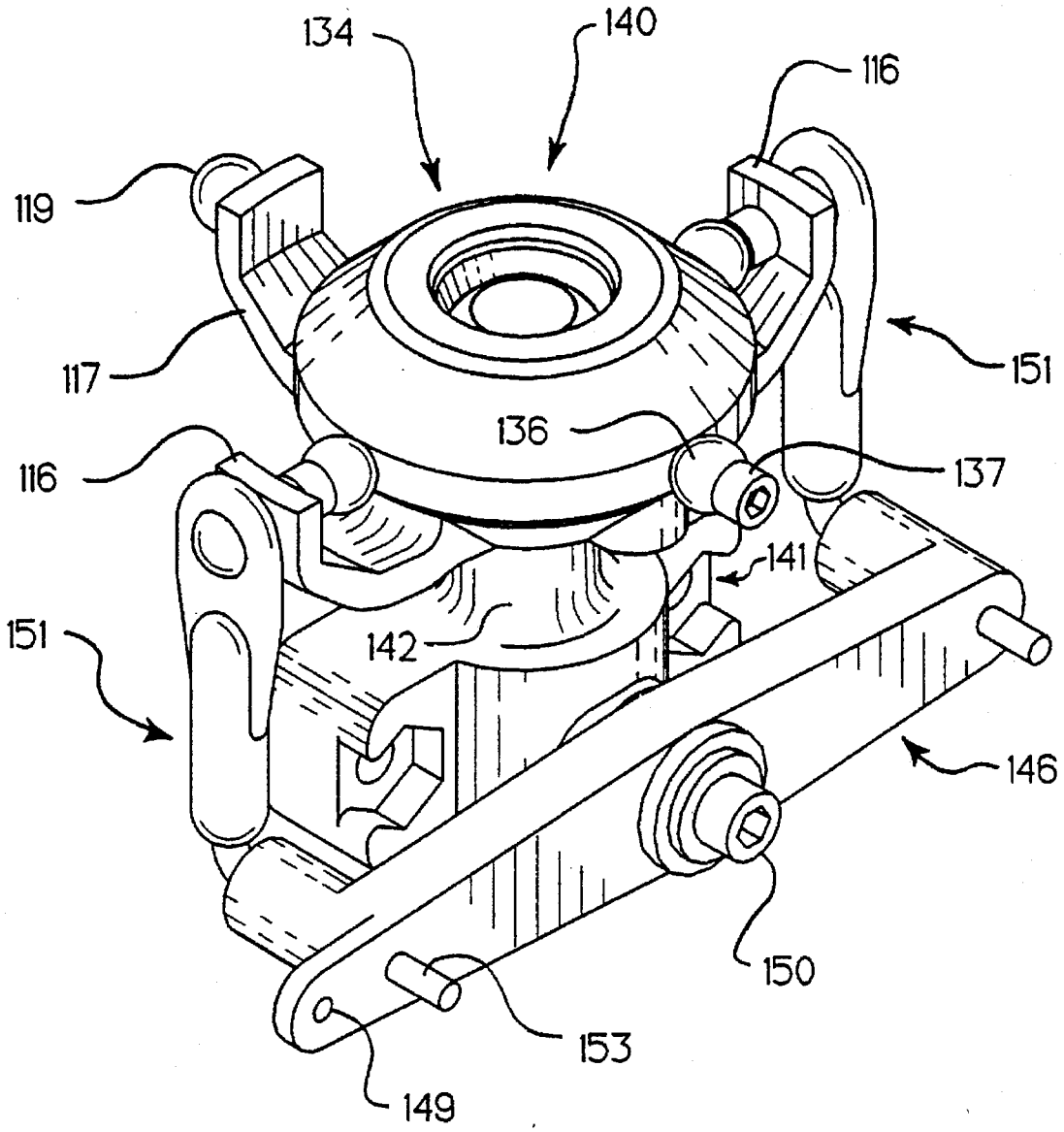
FIG. 17 is a perspective view of the mounted swashplate, with all other parts omitted for clarity.

Now referring to FIGS. 14, 16, and 17 swashplate hold-down arm 146 is pivotably secured to upper bearing block 141 by hold-down arm bolt 150. Fore-and-aft cyclic links 151 operably connect swashplate 140 to swashplate hold-own arm 146 and hold semi-spherical top 124 of swashplate inner race sleeve 121 against universal ball 143 thereby securing swashplate 140 to upper bearing block 141 for universal motion. Fore-and-aft cyclic links 151 also prevent rotation of swashplate arms 115 about shaft axis 9.

In operation, pilot control linkages attached to non-rotating swashplate arms 115 at roll ball-link 119 and fore-and-aft control link hole 149 can tilt swashplate 140 in any direction. Swashplate cap 134 rotates along with main rotor 1. When swashplate 140 is tilted by pilot control commands, subrotor pitch link 96 and swashplate link 73 transmit the commands to subrotor 83 and main rotor blades 100. Cyclic pitching of subrotor 83 can induce subrotor 83 to pivot cyclicly about teeter axis 82. Cyclic pivoting motion of subrotor 83 is transmitted through interconnected mixing arm 68, Z-link 74 and pitch arm 21 to pitch plate 20 thereby cyclicly pitching rotor blades 100.

Referring to FIG. 18, interconnected swashplate link 73, mixing arm 68, Z-link 74, and pitch arm 21 cyclicly transmit any tilt of swashplate 140 to pitch plate 20 and thereby to rotor blades 100. As shown in FIG. 18, swashplate 140 has been tilted to pivot rotor blades 100 about pitch axis 5 and thereby increase the pitch angle 99 of the leading edge 125 of rotor blade 100 to a positive angle-of-attack. Since two linkage paths from swashplate 140 to pitch plate 20 exist, one path is redundant. These dual linkage paths can be mechanically loaded against swashplate 140 by slightly lengthening swashplate link 73 thereby eliminating mechanical play in the linkage system. Proper spatial location of all link pivot points with respect to teeter axis 82, pitch axis 50, and swashplate 140 is essential for acceptable flight performance and to prevent binding of linkages. As linkages in one linkage path extend upward due to tilt of swashplate 140 or subrotor 83, linkages in the alternate path extend downward. Unless carefully designed, differences in the angular motions of the links can cause severe binding in some cases.

The following link dimensions, provided as distances between selected pivot points, provide a good balance between rotor controllability and stability, with low potential for binding.

Vertical Distances:

Pitch axis 50 to teeter axis 82=0.625 inch.

Center of swashplate 140 to pitch axis 50=1.625 inches.

Horizontal Distances:

Shaft axis 9 to swashplate ball-link 136=0.625 inch.

Pitch axis 50 to pitch plate outer Z-link hole=0.86 inch.

Pitch axis 50 to pitch plate inner Z-link hole=0.76 inch.

Teeter axis 82 to teeter mixing-arm bolt hole 66=1.375 inches.

Mixing arm swashplate-link hole 72 to teeter mixing-arm bolt hole 69=0.875 inch.

Mixing arm inner Z-link hole 70 to teeter mixing-arm bolt hole 69=0.685 inch.

Mixing arm outer Z-link hole 71 to teeter mixing-arm bolt hole 69=0.57 inch.

As can be seen in FIG. 19, interconnected follower link 46, follower arm 40, and subrotor pitch link 96 cyclicly transmit any tilt of swashplate 140 to subrotor 83 causing subrotor 83 to pitch cyclicly. Unequal separation of follower ball-link 45 and follower arm link-pin hole 43 from follower arm pivot-pin hole 41 amplifies angular displacement of swashplate 140.

Rotor blades 100 of the preferred embodiment of the current invention incorporate many advanced features. As shown in FIG. 19 in cutaway, the lower surface 126 of flapping detent 102 is slightly shorter than the upper surface 127 so that excessive flapping force applied to blade 100, as may be caused by contact with the ground in a crash, causes flapping limit-tab 59 on blade grip 55 to slip from flapping detent 102 in C-shaped blade root 101 allowing rotor blade 100 to fold upward 90 degrees or more about flapping or folding axis 61 through a folding angle 198, as shown in phantom in FIG. 1, thereby minimizing forces transmitted to the rest of the rotor head. Note that flapping limit tab 59 may alternately be located on rotor blade 100, and flapping detent 102 may be located on blade grip 55.

Figure 19A:
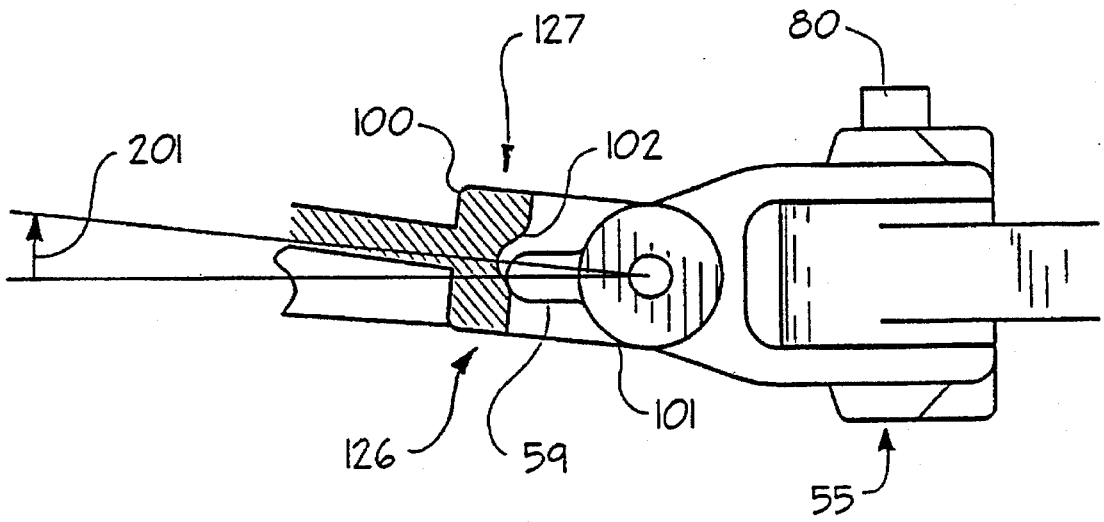
FIG. 19*a* is an enlarged side elevation view of the blade flapping mechanism of the main rotor system of FIG. 1 showing upward flapping operation of a rotor blade with portions of the rotor blade shown in cross section, and all elements of the main rotor system and the outboard portion of the rotor blade omitted for clarity.
Figure 19B:
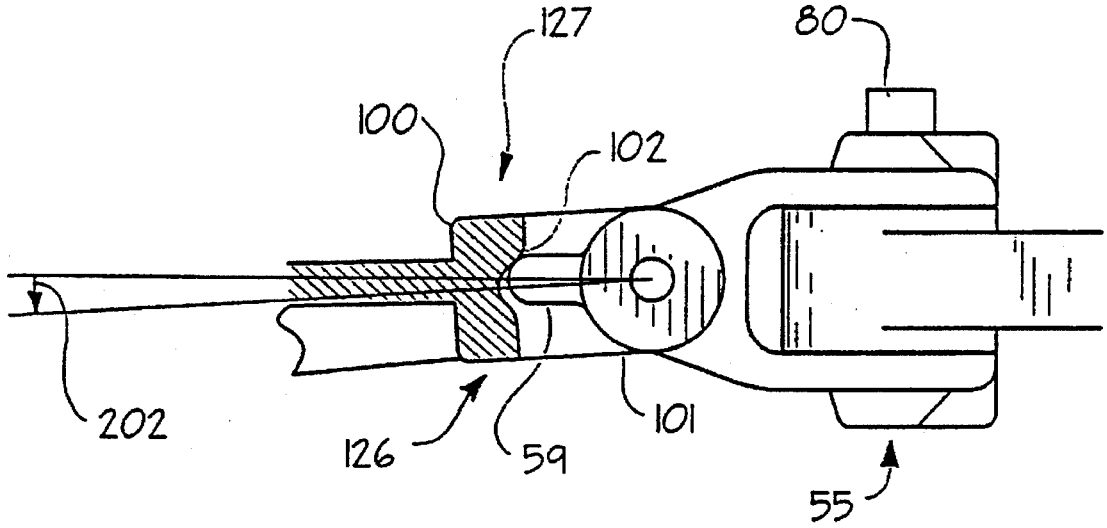
FIG. 19*b* is an enlarged side elevation view of the blade flapping mechanism of the main rotor system of FIG. 1 showing downward flapping operation of a rotor blade with portions of the rotor blade shown in cross sectino, and all elements of the main rotor system and the outboard portion fo the rotor blade omitted for clarity.

Refer to FIGS. 19*a* and 19*b* which illustrate flapping operation of rotor blade 100. In FIG. 19*a*, rotor blade 100 has flapped upward until lower surface 126 of flapping detent 102 contacts flapping limit-tab 59 on blade grip 55, thereby mechanically defining the upper limit of flapping of rotor blade 100 to upward flapping angle 201. Upward flapping angle 201 is shown to scale and is 6° in the illustrated embodiment.

In FIG. 19*b*, rotor blade 100 has flapped downward until upper surface 127 of flapping detent 102 contacts flapping limit-tab 59 on blade grip 55, thereby mechanically defining the limit of downward flapping of rotor blade 100 to downward flapping angle 202. Downward flapping angle 202 is shown to scale and is 3.5° in the illustrated embodiment.

As would be understood by one skilled in the art, the actual flapping angles through which rotor blade 100 pivots within the mechanically defined upper and lower limits of flapping are determined by the aerodynamic and gyroscopic forces encountered in flight.

Figure 20:
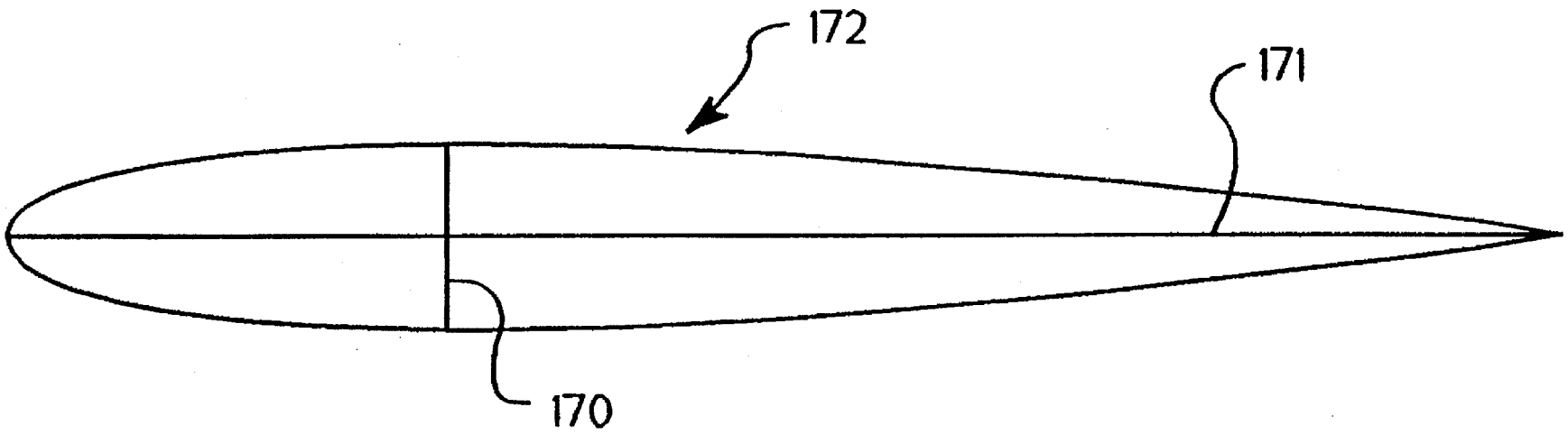
FIG. 20 is a cross-sectional view of a typical rotor blade.

Model helicopter rotors operate within a low speed range where aerodynamic drag due to rotor blade thickness becomes very important. Airfoil thickness is usually expressed as a percentage of the length of the airfoil. As shown in FIG. 20, airfoil thickness 170 of a typical rotor blade airfoil 172 is 12% of airfoil length 171. Therefore, the airfoiled cross section of airfoil 172 is 12% thick.

Now considering FIGS. 21*a–g*, airfoiled cross sections 103, 104, 105, 106, and 107 of rotor blade 100 are chosen to be as thin as possible to minimize drag, and curved (cambered) as shown in cross section to increase lift. In the preferred embodiment, airfoiled cross section 104 is 5.7% thick, 105 is 4.7% thick, 106 is 3.4% thick, and 107 is 4.1% thick. The platform of rotor blade 100 is tapered, and the blade twisted (washed-out) 10 degrees from root to tip for higher aerodynamic efficiency, as shown in FIGS. 21*a–g*. Rotor blade CG (center-of-gravity) 114 is located approximately 43% aft of the leading edge 125. Coning of the main rotor (when all blades flap upward simultaneously) tends to lift the center of gravity of the rotor blades out of the plane of rotation. Centrifugal restoring forces acting through the center of gravity of each blade section produce a pitch-up moment which helps offset the negative pitching moment of the cambered airfoils.

Rotor blades 100 are illustratively undercambered and thin (less than 8%). In addition, each rotor blade 100 is twisted and tapered as shown in FIGS. 21*a–6*. In a model helicopter application, such rotor blades 100 are used on a fixed-pitch rotor head as shown in the patent drawings. The result is a low-moment cambered rotor blade that functions to balance the pitching moment of the airfoil. A camber gives high lift—about 20–30% more than a traditional airfoil. The rotor blade 100 is designed so that its center of pressure is in front of the pitch axis 50 to counteract a diving moment due to camber (curvature) of the rotor blade. This provides means for counteracting the camber of the rotor blade to balance the pitching moment of the airfoil.

Illustratively, rotor blades 100 are foldable about a flapping axis and tabs or detents are provided at the root of the rotor blade 100 to limit flapping. Rotor blades 100 are preferably injection-molded and flexible so as to have a high resistance to damage.

In the preferred embodiment of the present invention for use on model helicopters, rotor blade 100 and most rotor head elements except fasteners, pins, and wire portions of links are molded of a plastics material such as nylon. This rotor head is considerably more aerodynamically efficient, durable, less costly, and easier to manufacture than any rotor head currently available.

In the preferred embodiments of the present invention, subrotor 83 has subrotor blades 84 that are shorter than main rotor blades 100. Advantageously, these shorter subrotor blades 84 replace Hiller paddles to enhance stability and control of the helicopter in flight (i.e., controlling, stabilizing main rotor). The improved subrotor blades 84 have blade portions which extend substantially inboard of the subrotor tips as compared to Hiller paddles which are rectangular and positioned to lie at the end of the flybar. Thin narrow blade extensions are provided to hold the subrotor blades 84 onto a pivot rod. Desirably, the subrotor blades are pitched upward into the airflow to add lift or reduce reversed airflow near the hub. Also, the subrotor blades 84 are provided with weights at the tips of each blade to increase the gyroscopic moment of each blade. These blade weights also function to entrap the subrotor pivot pin.

Another advantage of a main rotor in accordance with the present invention is the provision of blade grips 55. These blade grip 55 are interchangeable and define the relative angle between the flapping and lead-lag axes on the main rotor. They are provided with tabs or detents to limit blade flapping and they have a lead-lag axis inboard of the flapping axis.

Another feature of the present invention is the provision of simple and easy-to-manufacture control linkages. Ball joints of the type found in conventional helicopters are now replaced with Z-links or L-links that operably connect the swashplate 140, mixing arms, and the pitch plate 20. These control linkages provide redundant control paths that can be loaded to eliminate control slop in a fixed-pitch system. They also include multiple pin locations on mixing arms for different power/stability ratios.

Swashplate 140 in accordance with the present invention includes adjustable bearing races wherein the adjustable races can be screwed together and bolt means are provided to lock the races against unscrewing. Illustratively, swashplate arms are molded around the inner race sleeve. A swashplate support is also provided. An inner race sleeve engages the swashplate stalk for universal motion and the swashplate stock is connected to the main helicopter structure. Fore-and-aft cyclic links and swashplate hold-down arms secure the swashplate to the stalk and prevent rotation about the main rotor rotation axis 9. A pin hole is provided in swashplate arms and a detent is provided in the race ring to facilitate assembly.

Figure 22:
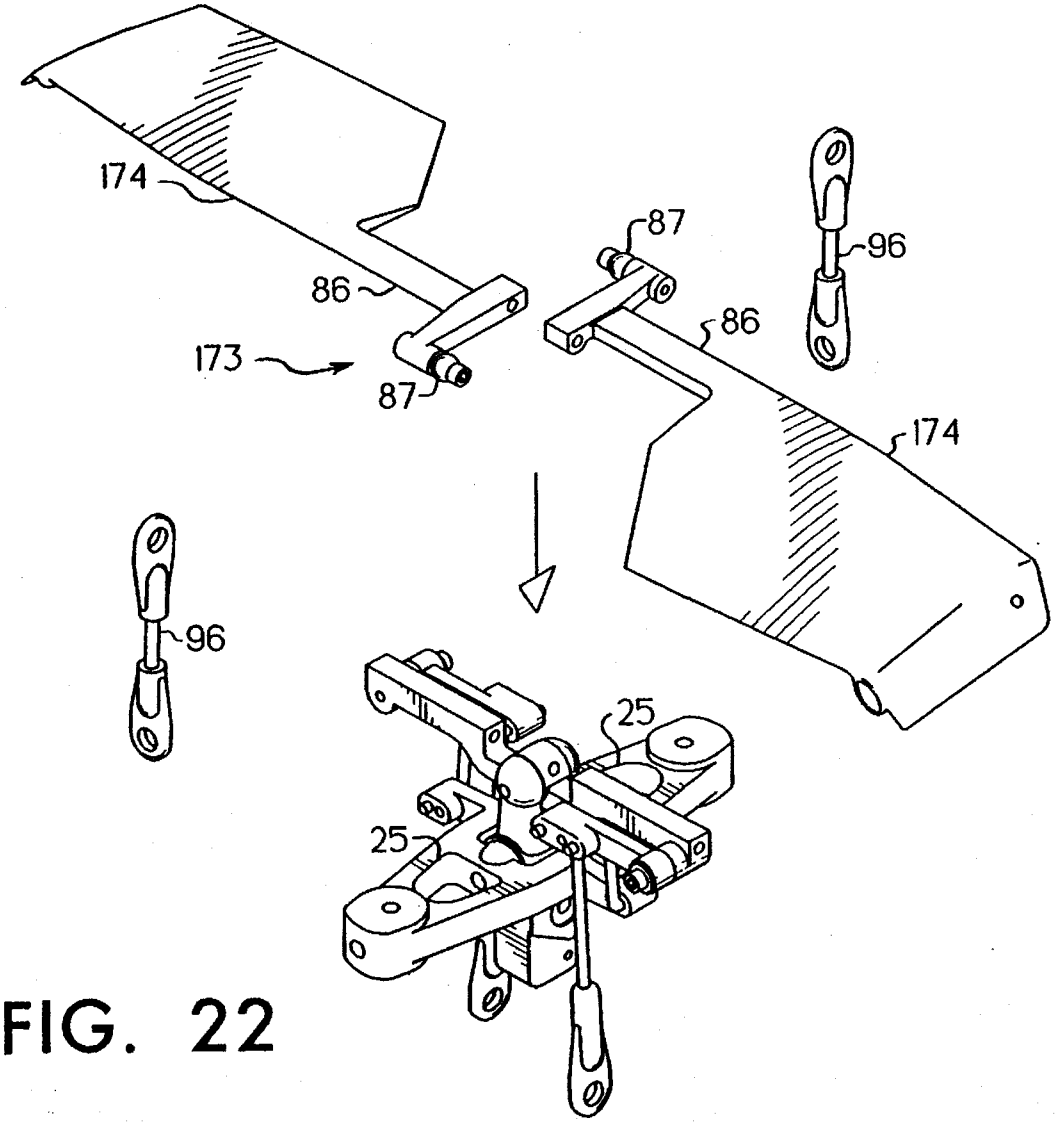
FIG. 22 is a perspective view of an alternate embodiment of the main rotor system employing collectively adjustable subrotor blades, with all other parts omitted for clarity.

Alternate embodiments of the current invention are contemplated wherein subrotor 83 is split into two independently variable subrotor blades. Referring to FIG. 22, split subrotor 173 comprises split subrotor blades 174 pivotably engaging modified teeter 63 with pivoting means similar to subrotor 83. Dual pitch links 96 extending through duel link clearance openings 25 are provided to pitch split subrotor blades 174 independently or in unison as for cyclic and collective control.

Although the invention has been described and defined in detail with reference to certain preferred embodiments, variations and modifications exist within the scope and spirit of the invention as described and defined in the following claims.

I claim:

1. A main rotor for use in a rotary winged model aircraft having a body, the main rotor comprising a rotor hub being formed to include a flapping limit tab, a plurality of main rotor blades extending radially from the rotor hub and supported for rotation about a substantially vertical axis and driven by drive means located within the body of the rotary winged model aircraft, and means for mounting the main rotor blades to said rotor hub to flap about a substantially horizontal flapping axis within a flapping limit range relative to the rotor hub yieldably constrained by engagement of the flapping limit tab and the main rotor blade and fold upward about a folding axis through a folding angle outside of the flapping limit range upon disengagement of the flapping limit tab and the main rotor blade so that forces transmitted to the rotor hub by the rotor blades during a crash landing of a rotary winged model aircraft including the main rotor are minimized due to movement of the rotor blades through said folding angle.

2. The main rotor of claim 1, wherein the mounting means includes means for reengaging the flapping limit tab and main rotor blade in the flapping limit range so that a rotary winged model aircraft including the main rotor is flightworthy without repair after a crash-landing of the rotary winged model aircraft including the main rotor.

3. The main rotor of claim 1, wherein the main rotor blade includes cam means for constraining the flapping limit tab within the flapping limit range while the main rotor blades react to aerodynamic and gyroscopic forces encountered by said main rotor blades in flight, permitting the flapping limit tab to disengage the cam means and move beyond the flapping limit range when the main rotor blades experience an excessive flapping force as may be caused by contact with the ground in a crash of the rotary winged model aircraft, and permitting the flapping limit tab to reengage the cam means within the flapping limit range without damaging the main rotor blades, mounting means, and rotor hub.

4. The main rotor of claim 1, wherein said rotor blade is foldable from a desired flight orientation that is substantially perpendicular to the rotor shaft toward a desired folded orientation that is substantially parallel to the main rotor shaft through the folding angle.

5. The main rotor of claim 1, wherein the flapping axis and folding axis coincide to form a single flapping/folding axis.

6. The main rotor of claim 1, wherein the rotor blade is made of a flexible plastics material such as nylon.

7. A main rotor for use in a rotary winged model aircraft, the main rotor comprising a rotor hub assembly rotatable about a main vertical axis, and at least two main rotor blades, each main rotor blade extending in a radial direction from the rotor hub assembly and having a tip end positioned to lie in spaced-apart relation to the rotor hub assembly and a root end coupled to the rotor hub assembly for pivotably folding movement from an initial horizontal position perpendicular to the main vertical axis about a horizontal axis through a folding angle of about 90°, whereby forces transmitted to the rotor hub by the rotor blade during a crash-landing of a rotary winged model aircraft including the main rotor are minimized due to movement of the rotor blades through said folding angle, wherein the rotor hub assembly includes a rotatable rotor hub and a blade grip for each main rotor blade, each blade grip has an inner portion coupled to the rotor hub for pivotable movement about an auxiliary vertical axis in spaced-apart parallel relation to the main vertical axis and an outer portion, and the root end of each main rotor blade is coupled to one of the outer portions for pivotable movement relative thereto about a horizontal axis, each blade grip includes a flapping limit tab, each main rotor blade includes a flapping detent positioned to be engaged by the flapping limit tab on a blade grip coupled to said main rotor blade and configured to slip from said flapping detent allowing said main rotor blade to fold upward 90° or more about the horizontal axis, thereby minimizing forces transmitted from the main rotor blades to the rotor hub.

8. A main rotor for use in a rotary winged model aircraft, the main rotor comprising a rotor rotation axis, a rotor hub supported for rotation about the rotor rotation axis in response to operation of an onboard motor drive unit, a plurality of rotor blades extending radially from the rotor hub, and rotor blade attachment means for connecting the rotor blades to the rotor hub, the rotor blade attachment means including folding means for pivotably mounting each rotor blade to the rotor hub to fold about a folding axis from an initial horizontal position perpendicular to the rotor rotation axis toward a folded vertical position through a folding angle of more than 6° that is in excess of a flapping angle defined by angular movement of said rotor blade relative to the initial horizontal position while reacting to the aerodynamic and gyroscopic forces encountered by said rotor blade in flight, whereby forces transmitted to the rotor hub by the rotor blade during a crash-landing of a rotary winged model aircraft including the main rotor are minimized due to movement of the rotor blades relative to the rotor hub through said folding angle.

9. The main rotor of claim 8, further comprising a rotor shaft having an upper end coupled to the rotor hub and an underlying lower end having means engaging a body portion of the rotary winged model aircraft and fold-limiting means for limiting downward folding of the rotor blades toward the lower end of the rotor shaft and the body of the rotary winged model aircraft.

10. The main rotor of claim 9, wherein the fold-limiting means further includes means for limiting upward folding of the rotor blades until an upwardly directed force in excess of a predetermined magnitude has been applied to the rotor blades.

11. The main rotor of claim 9, wherein the fold-limiting means comprises flapping limit tab means on the rotor hub and flapping detent means on each rotor blade responsive to excessive flapping forces applied to the rotor blades to cause the flapping limit tab means to slip from the flapping detent means allowing the rotor blades to fold upward toward their folded vertical positions upon impact with the ground during a crash-landing of the rotary winged model aircraft.

12. The main rotor of claim 9, wherein the fold-limiting means includes a detent on each rotor blade and a mating tab on the rotor hub, and the detent is configured to include ramp means for disengaging the tab upon impact of the rotor blade and the ground during a crash-landing of the rotary-winged model aircraft to allow each rotor blade to bid upwardly about a folding axis from the initial horizontal position perpendicular to the rotor rotation axis through the folding angle of more than 6° to the folded vertical position.

13. The main rotor of claim 8, wherein the rotor hub assembly includes a rotatable rotor hub and a blade grip for each main rotor blade, each blade grip has an inner portion coupled to the rotor hub for pivotable movement about an auxiliary vertical axis in spaced-apart parallel relation to the rotor rotation axis and an outer portion, and the root end of each main rotor blade is coupled to one of the outer portions for pivotable movement relative thereto about the folding axis.

14. The main rotor of claim 8, wherein the rotor blades are made of a nylon plastics material.

15. A main rotor for use on a rotary winged model aircraft, the main rotor comprising a rotor rotation axis, a rotor hub supported for rotation about the rotor rotation axis in response to operation of an onboard motor drive unit, a plurality of rotor blades extending radially from the rotor hub, and rotor blade pivot means for connecting each rotor blade to the rotor hub, the blade pivot means including lead/lag means for pivotably mounting each rotor blade to one of lead and lag about a vertical lead/lag axis and means for pivotably mounting each rotor blade to flap about a horizontal pivot axis through a limited flapping angle of 6° or less during rotation of the main rotor about the rotor rotation axis and reaction of the rotor blade to the aerodynamic and gyroscopic forces encountered in flight and to fold about the pivot axis through a folding angle of more than 6° that is in excess of the limited flapping angle, whereby forces transmitted to the rotor hub by the rotor blade during a crash-landing of a rotary winged model aircraft including the main rotor are minimized due to movement of the rotor blades through said folding angle.

16. The main rotor of claim 15, further comprising pitching means for pivotably mounting each rotor blade to the rotor hub to pitch about a pitching axis during rotation of the rotor hub about the rotor rotation axis.

17. The main rotor of claim 16, further comprising collective pitch adjustment means for adjusting the collective pitch of the rotor blades relative to the pitching means.

18. The main rotor of claim 17, wherein the collective pitch adjustment means includes means for changing the collective pitch of the rotor blades in predetermined, discrete, reproducible increments.

19. The device of claim 18, wherein the collective pitch adjustment means comprises interchangeable main rotor elements, said main rotor elements each having an intrinsic angle defining the pitch of a rotor blade such that replacement of said element with a like element defining a different intrinsic angle redefines the pitch of said rotor blade relative to the pitching means.

20. The device of claim 19, wherein the interchangeable main rotor elements include blade grips defining the relative angle between the horizontal flapping axes and the vertical lead/lag axes such that replacement of said blade grips redefines the relative angle between the horizontal flapping axes and vertical lead/lag axes, thereby setting the collective pitch of the rotor blades relative to the pitching means.

21. The device of claim 15, wherein the rotor hub assembly includes a rotatable rotor hub and a blade grip for each main rotor blade grip, each blade grip has an inner portion coupled to the rotor hub for pivotable movement about an auxiliary vertical axis in spaced-apart parallel relation to the rotor rotation axis and an outer portion, and the root end of each main rotor blade is coupled to one of the outer portions for pivotable movement relative thereto about the folding axis.

22. The device of claim 19, wherein each rotor blade is made of a nylon plastics material, the folding means comprises a C-shaped blade root pivotably secured to a blade grip, the pitch adjustment means comprises a blade grip made from a plastics material and defining the relative angle between the lead/lag and flapping axes of the rotor blade, the blade grip having a tab engageable in a detent in the C-shaped blade root for limiting flapping of the rotor blade, and the lead/lag means comprises a blade grip pivotably connected to the pitching means.

23. A main rotor for use in a rotary winged model aircraft, the main rotor comprising a rotor hub assembly rotatable about a main vertical axis, and at least two main rotor blades, each main rotor blade extending in a radial direction from the rotor hub assembly and having a tip end positioned to lie in spaced-apart relation to the rotor hub assembly and a root end coupled to the rotor hub assembly for pivotable folding movement from an initial horizontal position perpendicular to the main vertical axis about a horizontal axis through a desired folding angle of about 90°, whereby forces transmitted to the rotor hub by the rotor blade during a crash-landing of a rotary winged model aircraft including the main rotor are minimized due to movement of the rotor blades through said desired folding angle.

24. The main rotor of claim 23, wherein the rotor hub assembly includes a rotatable rotor hub and a blade grip for each main rotor blade, each blade grip has an inner portion coupled to the rotor hub for pivotable movement about an auxiliary vertical axis in spaced-apart parallel relation to the main vertical axis and an outer portion, and the root end of each main rotor blade is coupled to one of the outer portions for pivotable movement relative thereto about a horizontal axis.

25. The main rotor of claim 23, further including fold limiting means for limiting folding of the rotor blade until a desired amount of folding force has been applied to the rotor blade.

26. The main rotor of claim 25, wherein the fold limiting means comprises a flapping limit tab and a detent and the detent is formed to include cam means for permitting the flapping limit tab to disengage the detent during a crash of a model rotary winged model aircraft including the main rotor thereby allowing the rotor blade to fold about the horizontal axis through a desired folding angle.

27. The main rotor of claim 25, wherein the rotor blade is made of a flexible plastics material such as nylon.

28. The main rotor of claim 27, wherein each flapping detent includes an upper surface and a lower surface arranged to lie in spaced-apart relation to define a channel therebetween receiving the flapping limit tab therein and the lower surface is shorter in length than the upper surface.

29. The main rotor of claim 24, wherein each blade grip includes a body portion and a pair of grip fingers appended to the body portion and arranged to lie in spaced-apart relation to define a hub-receiving channel therebetween, a portion of the rotor hub extends into the hub-receiving channel formed in each blade grip, and a pivot pin is coupled to the pair of grip fingers and the outer portion of the rotor hub positioned in the hub-receiving channel formed therebetween to align the pivot pin in coextensive relation with the auxiliary vertical axis of the blade grip associated with the pivot pin.

30. The main rotor of claim 29, wherein each main rotor blade includes a blade portion interconnecting the tip and root ends, the root end is a C-shaped member formed to include a pair of spaced-apart blade root flapping holes, and each main rotor blade further includes a flapping bolt positioned to pass through the pair of spaced-apart blade root flapping holes formed in the C-shaped member.

31. The main rotor of claim 23, wherein each main rotor blade includes a blade portion interconnecting the tip and root ends, the root end is a C-shaped member formed to include a pair of spaced-apart blade root flapping holes, and each main rotor blade further includes a flapping bolt positioned to pass through the pair of spaced-apart blade root flapping holes formed in the C-shaped member and coupled to the rotor hub assembly.

32. The main rotor of claim 31, wherein the blade portion of each main rotor blade is cambered in cross section.

33. The main rotor of claim 32, wherein the blade portion of each main rotor blade is twisted 10° from the root end to the tip end.

34. The main rotor of claim 23, wherein each main rotor blade includes a leading edge extending between the tip and root ends and a trailing edge extending between the tip and root ends and lying in spaced-apart relation to the leading edge to establish a distance therebetween, and each main rotor blade is formed to position the center of gravity thereof at a point from the leading edge that is about 43% of the distance between the leading edge and the trailing edge.

35. The main rotor of claim 34, wherein the blade portion of each main rotor blade is twisted 10° from the root end to the tip end.

36. The main rotor of claim 23, wherein each main rotor blade is made of a nylon plastics material.

* * * * *